US006002384A

United States Patent [19]

Tamai et al.

[11] Patent Number: 6,002,384

[45] Date of Patent: Dec. 14, 1999

[54] APPARATUS FOR DRIVING DISPLAY APPARATUS

[75] Inventors: Shigeki Tamai, Kashihara; Yoshinori Ogawa, Yamatotakada, both of Japan

[73] Assignee: Sharp Kabushiki Kaisha, Osaka, Japan

[21] Appl. No.: 08/671,514

[22] Filed: Jun. 27, 1996

[30] Foreign Application Priority Data

Aug. 2, 1995 [JP] Japan ..... 7-197727
Oct. 5, 1995 [JP] Japan ..... 7-259091

[51] Int. Cl.[6] ..... G09G 3/36

[52] U.S. Cl. ..... 345/95; 345/89; 345/208; 345/92

[58] Field of Search ..... 345/87, 89, 94, 345/95, 96, 204, 205, 208, 209, 210, 63, 211, 148, 92, 147, 88

[56] References Cited

U.S. PATENT DOCUMENTS

| | | | |
|---|---|---|---|
| 5,196,738 | 3/1993 | Takahara et al. | 345/89 |
| 5,521,611 | 5/1996 | Okada et al. | 345/89 |
| 5,583,531 | 12/1996 | Okada et al. | 345/89 |
| 5,640,174 | 6/1997 | Kamei et al. | 345/89 |
| 5,642,127 | 6/1997 | Tamai | 345/95 |

FOREIGN PATENT DOCUMENTS

| | | | |
|---|---|---|---|
| 0484159 | 5/1992 | European Pat. Off. | 345/89 |
| 0532191 | 3/1993 | European Pat. Off. | 345/89 |
| 0627900 | 2/1994 | Japan . | |

*Primary Examiner*—Lun-Yi Lao

[57] ABSTRACT

Input connection terminals of a source driver of an active matrix type liquid crystal display panel, and analog switches are reduced in number. Two of four reference voltages V0, V2, V5 and V7 are combined with each other to output, in total, three combinations (V0, V2), (V2, V5) and (V5, V7) to two reference voltage lines and in each one of three first time periods W1*a*, W1*b* and W1*c*. Analog switches ASW0 and ASW2 for generating voltage are interposed in the respective reference voltage lines. The analog switches are turned on and off under control based on 3-bit display data D0, D1 and D2 for 8-level gradation in second time periods W2 and W3, which are shorter than the first time period W1, within any one of the first time periods W1, whereby a vibrating voltage is supplied to the source lines. Positively utilizing a low pass filter function of the source line due to the capacity and the resistance of the source line, voltages are averaged.

31 Claims, 31 Drawing Sheets

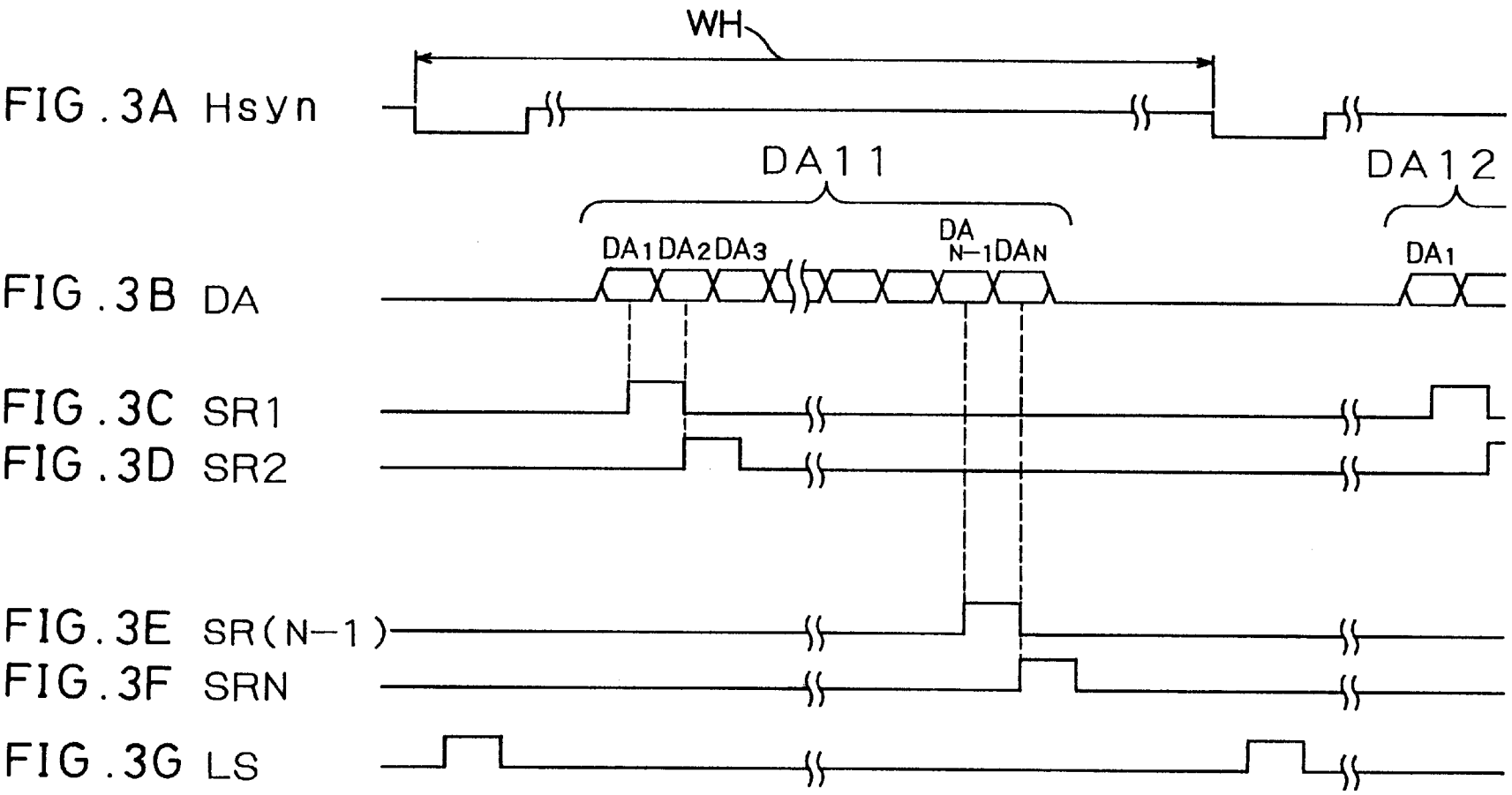
WH
DA11
DA12
DA1
DA1 DA2 DA3
DA N-1 DAN
FIG. 3A Hsyn
FIG. 3B DA
FIG. 3C SR1
FIG. 3D SR2
FIG. 3E SR(N-1)
FIG. 3F SRN
FIG. 3G LS

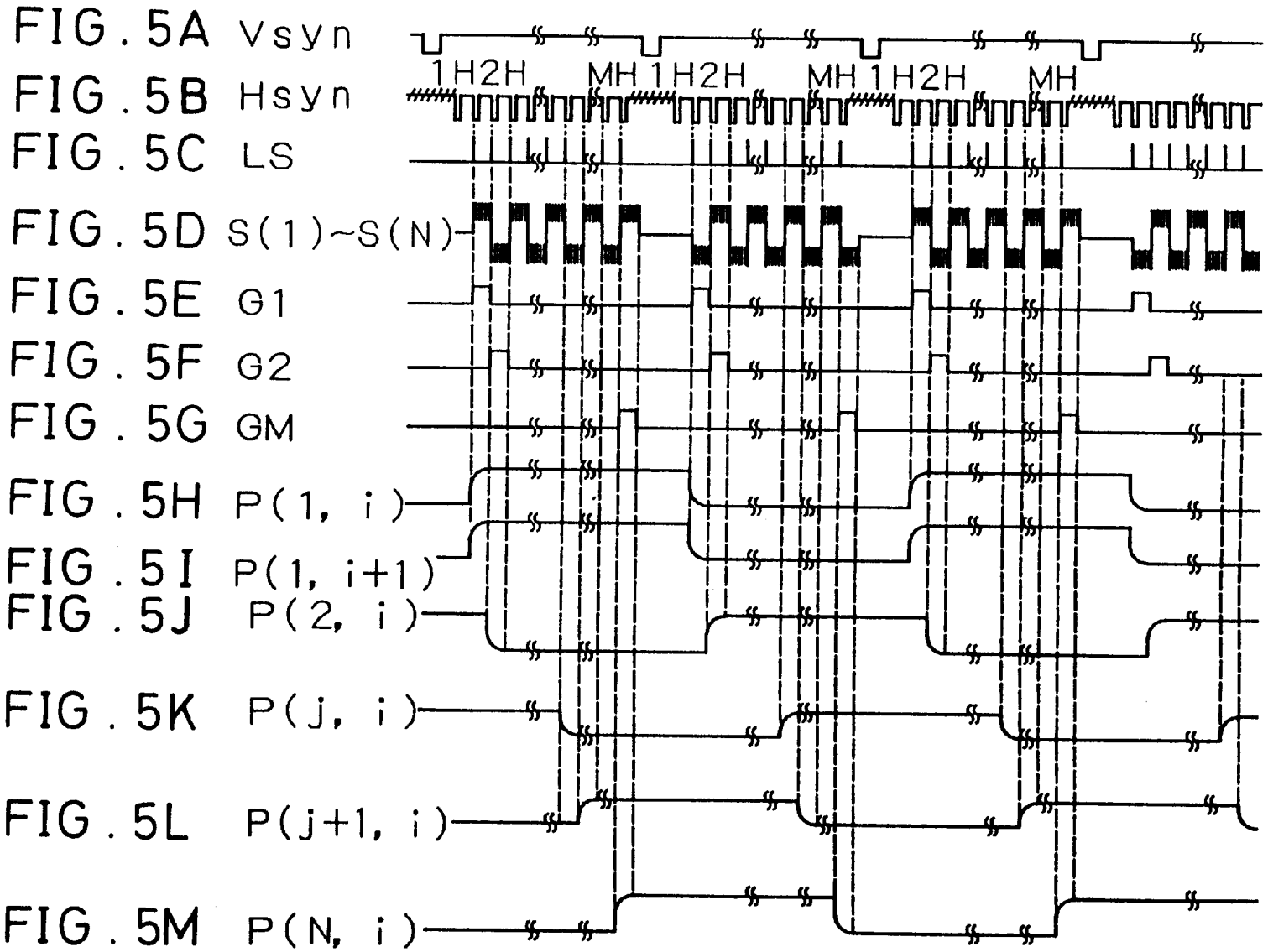
1H2H
MH
1H2H
MH
1H2H
MH
FIG. 5A Vsyn
FIG. 5B Hsyn
FIG. 5C LS
FIG. 5D S(1)~S(N)
FIG. 5E G1
FIG. 5F G2
FIG. 5G GM
FIG. 5H P(1, i)
FIG. 5I P(1, i+1)
FIG. 5J P(2, i)
FIG. 5K P(j, i)
FIG. 5L P(j+1, i)
FIG. 5M P(N, i)

FIG. 12A CK
FIG. 12B DUTY
FIG. 12C SV1
FIG. 12D SV2
FIG. 12E SV3
FIG. 12F AV
FIG. 12G BV
FIG. 12H d0
FIG. 12I d1
FIG. 12J d2
FIG. 12K AS0
FIG. 12L AS2

FIG. 27A CK
FIG. 27B DUTY
FIG. 27C FQ3
FIG. 27D FQ4
FIG. 27E FQ4*
FIG. 27F FQ5
FIG. 27G FQ5*
FIG. 27H FQ6
FIG. 27I FQ6*
FIG. 27J FQ7
FIG. 27K FQ7*
FIG. 27L VS1
FIG. 27M VS2
FIG. 27N VS3
FIG. 27O BV
FIG. 27P AV

APPARATUS FOR DRIVING DISPLAY APPARATUS

BACKGROUND OF THE INVENTION

1. Field of the Invention

The present invention relates to an apparatus for driving a display apparatus such as an active matrix type liquid crystal display apparatus.

2. Description of the Background Art a typical prior art system is shown in FIG. 29. On a display panel 11 which forms an active matrix liquid crystal display apparatus, source lines 01 to 0N and gate lines L1 to LM are formed in a matrix. A thin film transistor T is arranged at each of the intersections of the source lines and gate lines. Through the transistors T, voltages of the source lines 01 to 0N are selectively supplied to pixel electrodes P. The source lines 01 to 0N are connected to a source driver 12 which is composed of a semiconductor integrated circuit. The source driver 12 selects one voltage from among eight different voltages V0 to V7 in total of a reference voltage source 13 in accordance with display data D0 to D2 each consisting of three bits and each corresponding to each source line 0k (k=1 to N). It then supplies selected voltages to the source lines 01 to 0N. A gate driver 14 composed of a semiconductor integrated circuit outputs gate signals G1 to GM to the gate lines L1 to LM. During one horizontal scanning period when each gate signal Gj (j=1 to M) is being supplied, the source driver 12 supplies voltages corresponding to the gradations of then respective pixel electrodes P, to the source line 0k.

FIG. 30 is a block diagram concretely showing a partial constitution of a prior art source driver 12 as shown in FIG. 29. The source driver 12 comprises decoder circuits FRk (k=1 to N) which individually correspond to the respective source lines 01 to 0N, respond to each data d0 to d2 corresponding to gradation display data D0 to D2, and selectively supply the eight different voltages V0 to V7 from the reference voltage source 13 to the source lines 0k through analog switches ASW0 to ASW7 to which signals S0 to S7 are respectively supplied, whereby eight-level gradation display is realized.

In the prior art as shown in FIGS. 29 and 30, the voltages V0 to V7 corresponding to gradation levels are each supplied from the reference voltage source 13 to the source driver 12. Hence, input terminals of necessary number for receiving the voltages V0 to V7 are required, and additionally the analog switches ASW0 to ASW7 are needed which respectively correspond to the gradation levels. Accordingly, a reduction of the number of input terminals is desired. Furthermore, in order to realize cost reduction, it is desired to reduce the number of the analog switches ASW0 to ASW7 to reduce the chip size of the source driver 12 composed of a semiconductor integrated circuit.

The analog switches ASW0 to ASW7 of the source driver 12 each need to have a sufficiently low ON-state resistance in order to correctly write the level of a selected one of the voltages V0 to V7 in the source lines 01 to 0N of the display panel 11 which are connected outside the source driver 12. For this reason, the area the analog switches ASW0 to ASW7 occupy in the semiconductor ship is generally about ten times to several ten times as large as a logic circuit element which is turned on and off for computation within the source driver 12. Thus, the analog switches ASW0 to ASW7 account for a large area within the semiconductor chip of the source driver 12. Hence, an increase in the number of the analog switches ASW0 to ASW7 for higher levels of gradation display directly increase the chip size of the semiconductor chip.

According to the prior art as shown in FIGS. 29 and 30, for example, in the case of a 16-level gradation display using 4-bit display data, input terminals for sixteen different reference voltages are necessary, and additionally sixteen analog switches in total are necessary which correspond to the respective reference voltages.

Another prior art system in which a small-sized semiconductor is realized by reducing numbers of the input terminals for the reference voltages and the analog switches is disclosed in Japanese Unexamined patent Publication No. 6-27900, which was proposed by the inventor of the present invention. A basic constitution according to the latter prior art is similar to the art shown in FIG. 29, and a partial constitution of the source driver 12 is shown in FIG. 31. According to the latter conventional technique, four different reference voltages V0, V2, V5 and V7 in total are generated in the reference voltage source 13 and are supplied to a source diver 12*a*. In the source driver 12*a*, four analog switches ASW0, ASW2, ASW5 and ASW7 corresponding to the reference voltages V0, V2, V5, V7, respectively, feed the reference voltages V0, V2, V5 and V7 directly to source lines 0h (h=1 to N). In addition, voltages V1, V3, V4 and V6 are generated from vibration between these reference voltages, so that in total eight different voltages V0, V1, V2, V3, V4, V5, V6 and V7 corresponding to eight gradations are outputted. Hence, responding to data d0 to d2 which correspond to data D0 to D2 of eight-level gradation display, a decoder circuit GRh outputs a selected one of the reference voltages V0, V2, V5 and V7 to the source line 0h. Additionally the intermediate voltages V1, V3, V4 and V6 are outputted to source line 0h by time-sharing the reference voltages V0, V2, V5 and V7. For example, the intermediate voltage V1 is outputted by time-sharing the reference voltages V0 and V2 and alternately outputting the time-shared voltages to the source line 0h. If the reference voltage V7 is set to be higher than the reference voltage V0, the relationship between the voltages is V0<V1<V2<V3<V4<V5<V6<V7. the analog switches ASW0, ASW2, ASW5 and ASW7 are on-off-controlled by signals AS0, AS2, AS5 and AS7, respectively.

For example, in the case where the intermediate voltage V3 between the reference voltages V2 and V5 is generated and applied to the source line 0h, in one predetermined outputting period, the decoder circuit GRh alternately turns on and off the analog switches ASW2 and ASW5 as shown in FIG. 32A, and generates a vibration voltage as shown in FIG. 32A. Thereby, due to the resistance and capacity of the source line 0h, the voltage of the source line 0h becomes similar to a voltage which is filtered by a low pass filter as shown in FIG. 32B and eventually becomes the averaged voltage V3 shown in FIG. 32C, which will be applied to the pixel electrodes P through the transistors T.

Once being applied to the pixel electrodes P, voltages are held by a capacity between the pixel electrodes P and a common electrode disposed facing the pixel electrodes P through the liquid crystal. This operation is repeated for every one of the gate lines L1 to LM with respect to the source lines 01 to 0N, whereby the voltages V0 to V7 are held over one vertical period, for example.

The prior art of FIGS. 31 and 32 only needs in total four different reference voltages V0, V2, V5 and V7 for gradation display using the eight-level gradation display data D0 to D2 each composed of three bits. Consequently only the four analog switches ASW0, ASW2, ASW5 and ASW7 in total are necessary. Thus, the eight different voltages V0 to V7 corresponding to the respective gradations can be used by the reference voltages and analog switches whose numbers do not exceed the number of gradations. Accordingly, as compared with the prior art as shown in FIGS. 29 and 30, the number of the reference voltages which are generated by the reference voltage source 13 is smaller, and correspondingly the number of the analog switches can be reduced. Hence, the semiconductor ship of the source driver 12 can be small-sized, which in turn suppresses a consumption current. This eventually realizes lowered cost and high density packaging.

However, in practice, particularly in liquid crystal display apparatuses for office automation equipment, in order to obtain a further small-sized semiconductor ship, further higher levels of gradation display semiconductor chip, further higher levels of gradation display and further reduction of input terminals in number are demanded.

SUMMARY OF THE INVENTION

An object of the present invention is to obtain an apparatus for driving a display apparatus capable of reducing the size of a semiconductor ship in a source driver, lowering of consumption power and cost, and packaging in high density by reducing number of connection terminals and analog switches while increasing number of level of gradation display.

The invention provides an apparatus for driving a display apparatus, which outputs on reference voltage continuously or at least two reference voltages in time sharing mode, to the display apparatus, the one or at least two reference voltages being selected from among plural direct current reference voltages generated by a reference voltage source in accordance to display data, the apparatus for driving a display apparatus comprising:

plural input terminals to which the plural reference voltages are applied respectively;

output terminals connected to the display apparatus;

a switching element interposed between each input terminal and each output terminal, which is turned on or off in response to a control signal; and control means for outputting the control signal on the basis of the display data, the apparatus further comprising:

multiple value voltage generation means for supplying different voltages from the reference voltage source to the input terminals in time sharing mode, wherein the control means outputs the control signal for on-off control of the switching element in a predetermined timing corresponding to the display data.

According to the invention, the plural reference voltages forming the reference voltage source are supplied to the plural input terminals respectively, from which the plural reference voltages are supplied via the switching element such as an analog switch to the output terminal, from which drive voltage is supplied to the display apparatus, and to the input terminals different reference voltages from the reference voltage source are supplied in a time sharing mode by the multiple value voltage generation means interposed between the reference voltage source and the input terminals. Further, the control means output the control signal for on-off control of the switching element in a predetermined timing corresponding to the display data. So-called vibration voltages between the reference voltages are obtained by such on-off operation of the switching element. Thereby reference voltages and the intermediate voltages between the reference voltages, which are drive voltages for multiple level gradation display, can be obtained.

The invention provides an apparatus for driving a display apparatus, which outputs one reference voltage continuously or at least two reference voltages in a time sharing mode, to the display apparatus, the one or at least two reference voltages being selected from among plural direct current reference voltages generated by a reference voltage source in accordance to display data, the apparatus for driving a display apparatus comprising:

plural input terminals to which the plural reference voltages are applied respectively;

output terminals connected to the display apparatus;

a switching element interposed between each input terminal and each output terminal, which is turned on or off in response to a control signal; and control means for outputting the control signal for on-off control of the switching element on the basis of the display data, the apparatus further comprising:

multiple value voltage generation means for supplying different voltages supplied from the reference voltage source to the input terminals in time sharing mode, wherein the multiple value voltage generation means for supplying different voltages supplied form the reference voltage source to the input terminals in time sharing mode, wherein the multiple value voltage generation means in which slit periods when any reference voltage is not outputted are inserted in intervals from the ends of periods when the respective reference voltages are outputted, to the starts of periods when the respective following reference voltages are outputted, when changeover of the reference voltages is conducted, and wherein the control means outputs the control signal for on-off control of the switching element in a predetermined timing corresponding to the display data.

According to the invention, the different voltages supplied from the reference voltage source are supplied to the input terminals a time sharing mode by the multiple value voltage generation means. When the reference voltage which is to be supplied to the input terminal is changed over, a slit period when no reference voltage is selected is inserted, the on-off control of the switching element is conducted with the control signal outputted from the control means in a predetermined timing on the basis of the display data in a period where any reference voltage is selected, and a voltage prepared on the basis of the reference voltage corresponding to the display is supplied from the output terminal to the display apparatus. Accordingly the reference voltages and voltages between the simultaneously inputted reference voltages selected from among the reference voltages can be outputted and more voltages than the number of the reference voltages inputted into the drive apparatus can be outputted to the display apparatus. Additionally, since, when changeover of the reference voltages is conducted, a slit period when no reference voltage is outputted is inserted, through current between two reference voltages caused by simultaneous selection of the two reference voltages is prevents.

Further the invention is characterized in that one pair of input terminals corresponding to each output terminal is provided, the switching element is interposed between each output terminal and each input terminal of each pair of input terminals corresponding to the output terminal, the multiple value voltage generation means supplies the reference voltages to the input terminals corresponding to the respective output terminals in sequence of from high to low or from low to high of the voltages with the lapse of time in time sharing mode in each repeated cycle in plural times, and the reference voltages supplied at one time to the respective input terminals of the respective pairs of input terminals are shifted by one reference voltage.

According to the invention, as seen from an embodiment shown in FIGS. 1 to 14, particularly in FIGS. 12 and 13 the reference voltages (V0, V2), (V@, V5) and (V5, V7) supplied at one time in the periods W1a, W1b and W1c, respectively, are shifted by one reference voltage in sequence of from high to low or from low to high of the reference voltages. For example, in FIG. 12, a voltage AV supplied to one of each pair of input terminals is supplied in order to V0, V2 and V5. On the other hand, a voltage BV supplied to the other of each pair of input terminals is supplied in order of V2, V5 and V7. According to such constitution, all the reference voltages V0, V2, V5 and V7 and the vibration voltages between the reference voltages V0, V2, V5 and V7 are used as drive voltages for multiple-level gradation display.

Further the present invention is characterized in that at least two pairs of input terminals corresponding to each output terminal are provided, a switching element is interposed between each output terminal and each input terminal of each pair of input terminals corresponding to the output terminal, the plural reference voltages generated b the multiple value voltage generation means are divided into plural groups for each pair of input terminals, the multiple value voltage generation means supplies the reference voltages to the respective pairs of input terminals in plural times in sequence of from high to low or from low to high of the voltages with the lapse of time in time sharing mode in each repeated cycle, and the reference voltages supplied at one time to the input terminals of the respective pairs of input terminals are shifted by one reference voltage.

According to the invention, as seen from an embodiment shown in FIGS. 16 and 17, at least two pairs of input terminals are provided so as to correspond to each output terminal, and the reference voltages are divided into plural groups for the pairs of input terminals. For example, as shown in Table 3, they are divided into two groups, and the reference voltages in the groups and intermediate voltages therebetween can be used as drive voltages for multiple gradations.

Furthermore the invention is characterized in that a first plurality of input terminals are provided so as to correspond to the respective output terminals, a switching element is interposed between each output terminal and the input terminal corresponding to each output terminal, the multiple value voltage generation means supplies a second plurality of reference voltages larger in number than the first plurality of input terminals to the input terminals corresponding to the respective output terminals in sequence of from high to low or from low to high of the voltages with the lapse of time in time sharing mode in each repeated cycle in plural times, and the reference voltages supplied at one time to the input terminals in each supply excluding the first supply in each cycle contains one of the reference voltages supplied in the preceding supply.

According to the invention, as an embodiment of the invention shown in FIGS. 22 and 23 and another embodiment of the invention shown in FIG. 24, the first plurality of input terminals corresponding to one output terminal are provided, the second plurality of reference voltages larger in number than the first plurality of input terminals are supplied in periods of one repeated cycle W0, for example, in periods W1a, W1b and W1c, and the reference voltage supplied at one time to the input terminals includes only one reference voltage V2 or V4 of the reference voltages supplied in the period W1b and W1c excluding the period W1a of the cycle W0, respectively. Thereby the second plurality of reference voltages and the intermediate voltages thereamong can be used as drive voltages for multiple level gradation.

Further the invention is characterized in that:

the switching element and the control means are realized by a first integrated circuit, and multiple value voltage generation means is realized by a second integrated circuit.

According to the invention, the input terminals of the first integrated circuit to which the reference voltages from the multiple value voltage generation means of the second integrated circuit are supplied can be reduced in number, resulting in simplification of the constitution of the first integrated circuit.

Further the invention is characterized in that the switching element and the multiple value voltage generation means are realized by one integrated circuit.

According to the invention, the reference voltages from the multiple value voltage generation means are supplied via the reference voltage lines 23 and 24 in common integrated circuit to the switching element, resulting in reducing the reference voltage lines, namely input terminals for inputting from the multiple value voltage generation means to the switching element, in number.

Further the invention is characterized in that the first integrated circuits are provided in plural, and the second integrated circuit is common to all the plural first integrated circuits.

According to the invention, the second integrated circuit is common to all the plural integrated circuits, resulting in simplification of constitution.

Further the invention is characterized in that the multiple value voltage generation means includes an analog switch which is interposed between the line to which the plurality of reference voltages are derived from the reference voltage source and each input terminal, and is turned on an off by a reference voltage control signal, and the reference voltage signal is periodically generated and supplied to the analog switch.

According to the invention, the analog switch is turned on and off by the reference voltage control signal to control the reference voltages to supply to the input terminals.

Further the invention is characterized in that a slit period synchronized with a predetermined cycle of reference voltage output from the multiple value voltage generation means is provided.

According to the invention, the slit period is provided so as to by synchronized with the predetermined cycle of reference voltage selection. Accordingly, not only is through current between the reference voltages prevented, but also adverse effects on display such as time lag in on/off control of control signal, which is possible to occur due to the slit period, can be eliminated.

The invention is applied to liquid crystal display panels, and is also applied to display panels using other dielectric layers. For example, instead of liquid crystal, electroluminescence (EL) materials may be used.

According to the invention, in the case where the invention is applied to a constitution of an active matrix liquid crystal display apparatus wherein a pixel switching element such as a thin film switching element is provided, intermediate voltages generated by vibration between reference voltages can be maintained on the basis of the reference voltages between the plural pixel electrodes and the single common electrode common to the pixel electrodes, and the reference voltages, for example, over one vertical scanning period. Thus, the invention is preferably embodied in connection with an active matrix type display apparatus.

According to the invention, since the intermediate voltages between the reference voltages are obtained by on/off control of the switching element in a predetermined timing corresponding to display data, so-called vibration, so as to supply reference voltages from the multiple value voltage generation means in a time sharing mode, the connection terminals and switching elements such as analog switches can be reduced in number. As a result multiple level gradation display is easily realized, and semiconductor integrated circuits such as a source driver can be easily mass-produced.

Further according to the invention, since, when the reference voltages to be inputted to the input terminals are shifted, a slit period when no reference voltage is outputted is provided, through current between two reference voltages caused by simultaneous selection of the two reference voltages is prevented with the result that consumption power of an apparatus for driving a display apparatus can be reduced.

Further according to the invention, as described above, since the input terminals and switching elements can be reduced in number, it is possible to satisfy various requirements such as simplification of constitution, lowering of consumption power and cost, and packaging in high density.

Still further, according to the invention, since the switching elements can be reduced in number, the ratio of the area of the switching elements to the total area of the semiconductor chip becomes smaller with the result of obtaining small-sized semiconductor chips. Additionally, on-state resistance can be sufficiently lowered.

Still further according to the invention, the combinations of the reference voltages supplied to the reference voltage lines may be different from each other and therefore it is possible to efficiently obtain desired intermediate voltages between the reference voltages.

Further according to the invention, since the switching elements, control means and multiple value voltage generation means are included in one integrated circuit, connection terminal can be reduced in number.

Further according to the invention, since the number of the second integrated circuit is one, which are common to the plural first integrated circuits, the apparatus is simplified in constitution.

Further according to the invention, since the slit period is provided so as to be synchronized with the predetermined cycle of reference voltage selection, not only is through current between the reference voltages prevented, but also adverse effects on display such as time lag in on/off control of control signal, which is possible to occur due to the slit period, can be eliminated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other and further objects, features, and advantages of the invention will be more explicit from the following detailed description taken with reference to the drawings wherein:

FIGS. 3A to 3G are views for describing an operation of one horizontal scanning period WH in the embodiment;

FIGS. 5A to 5M are views for describing an operation of a driving voltage which corresponds to each pixel P;

DETAILED DESCRIPTION OF THE PREFERRED EMBODIMENTS

Figure 1:
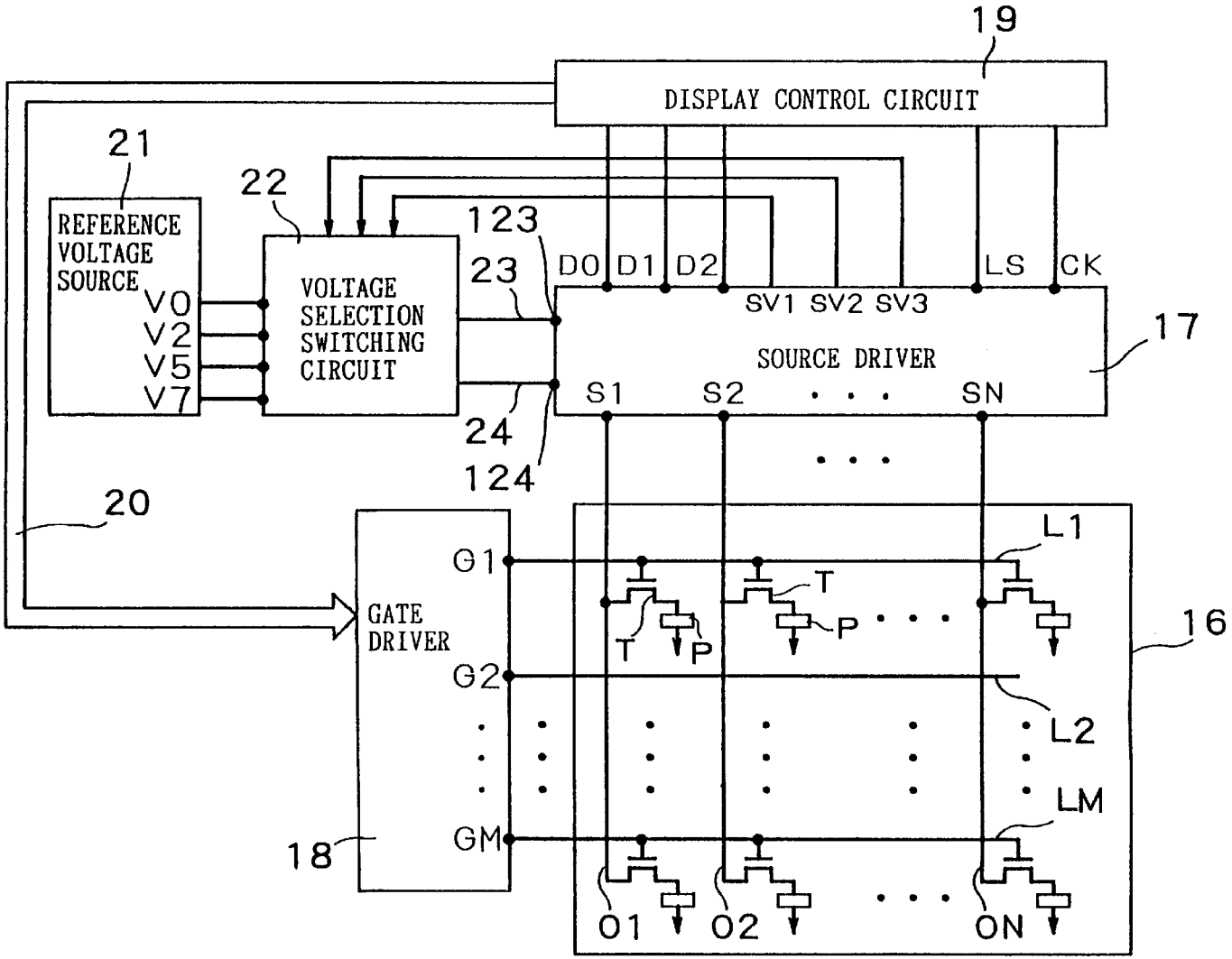
FIG. 1 is a block diagram showing an overall structure of an embodiment of the invention.

Now referring to the drawings, preferred embodiments of the invention are described below.

FIG. 1 is a block diagram showing an electric structure of an embodiment of the invention. In an active matrix type liquid crystal display panel 16, first lines, i.e., source lines 01 to 0N and second lines, i.e., gate lines L1 to LM are arranged in a matrix of M rows and N columns on one substrate. At intersections of the lines 01 to 0N and L1 to LM, thin film transistors (abbreviated as "TFT") which serve as pixel switching elements T (j, i) (j=1 to M, i=1 to N) are arranged. When gate signals G1 to GM are serially supplied to the gate lines L1 to LM, thin film transistors T which have gate electrodes connected to the gate lines L1 to LM receiving the gate signal Gj become conductive. As a result, gradation display driving voltages from the source lines 01 to 0N are supplied to the pixel electrodes P (j, i) through conductive thin film transistors T. On the other substrate which faces the one substrate through a liquid crystal, a common electrode which faces all of the pixel electrodes P are formed. Gradation display is realized because of an electric field which is created between the common electrode and the pixel electrodes P to which the driving voltages are selectively supplied.

The source lines 01 to 0N are connected to output terminals S1 to SN of a source driver 17 which is formed by a semiconductor integrated circuit. The gate lines L1 to LM are connected to input connection terminals G1 to GM of a gate driver 18 which is formed by a semiconductor integrated circuit. In a description hereinafter, lines and signals which are supplied to the lines will be sometimes denoted by the same reference characters.

During each horizontal scanning period WH in which the gate lines L1 to LM serially turn to a high level, a thin film transistor T which has a gate electrode connected to a gate line Lj which is at the high level becomes conductive. Hence, the driving voltages which correspond to gradation display data supplied through the source lines 01 to 0N are charged up between the pixel electrodes P and the common electrode. Voltage levels thus charged up are held during one vertical scanning period in which in total M gate lines L1 to LM are scanned, whereby gradation display is realized in each pixel.

Gradation display data D0 to D2 each consisting of serial three bits are serially supplied to the source driver 17 from a display control circuit 19 in correspondence with the source lines 01 to 0N. At this stage, the display control circuit 19 generates a clock signal CK and a latch signal LS and supplies these signals to the source driver 17. These reference characters D0–D2, CK and LS are hereinafter used to indicate signals, input connection terminals and lines. Other reference characters also are used in order to indicate signals, input connection terminals and lines.

The display control circuit 19 also supplies a signal which is synchronized with the clock signal CK and the latch signal LS to the gate driver 18 through a line 20. As described above, the gate driver 18 supplies the gate signals G1 to GM serially to the gate lines L1 to LM in synchronization.

A reference voltage source 21 is disposed to supply driving voltages to the source lines 01 to 0N. The reference voltage source 21 always generates four types of dc reference voltages V0, V2, V5 and V7. A voltage selection switching circuit 22 is disposed between reference voltage output terminals V0, V2, VS and V7 of the reference voltage source 21 and a plurality of reference voltage lines 23 and 24 (two power source lines in this embodiment). The voltage selection switching circuit 22 sequentially supplies one of three voltage combinations (V0, V2), (V2, V5) and (V5, V7) each consisting of two reference voltages to the reference voltage lines 23 and 24. The combination voltages are generated in first time periods W1a, W1b and W1c which are defined on the basis of reference voltage control signals SV1, SV2 and SV3 which are supplied from the source driver 17. In the embodiment of the invention, W1a=W1b=W1c and the first time periods W1a, W1b and W1c will be sometimes generally referred to as W1.

Figure 2:
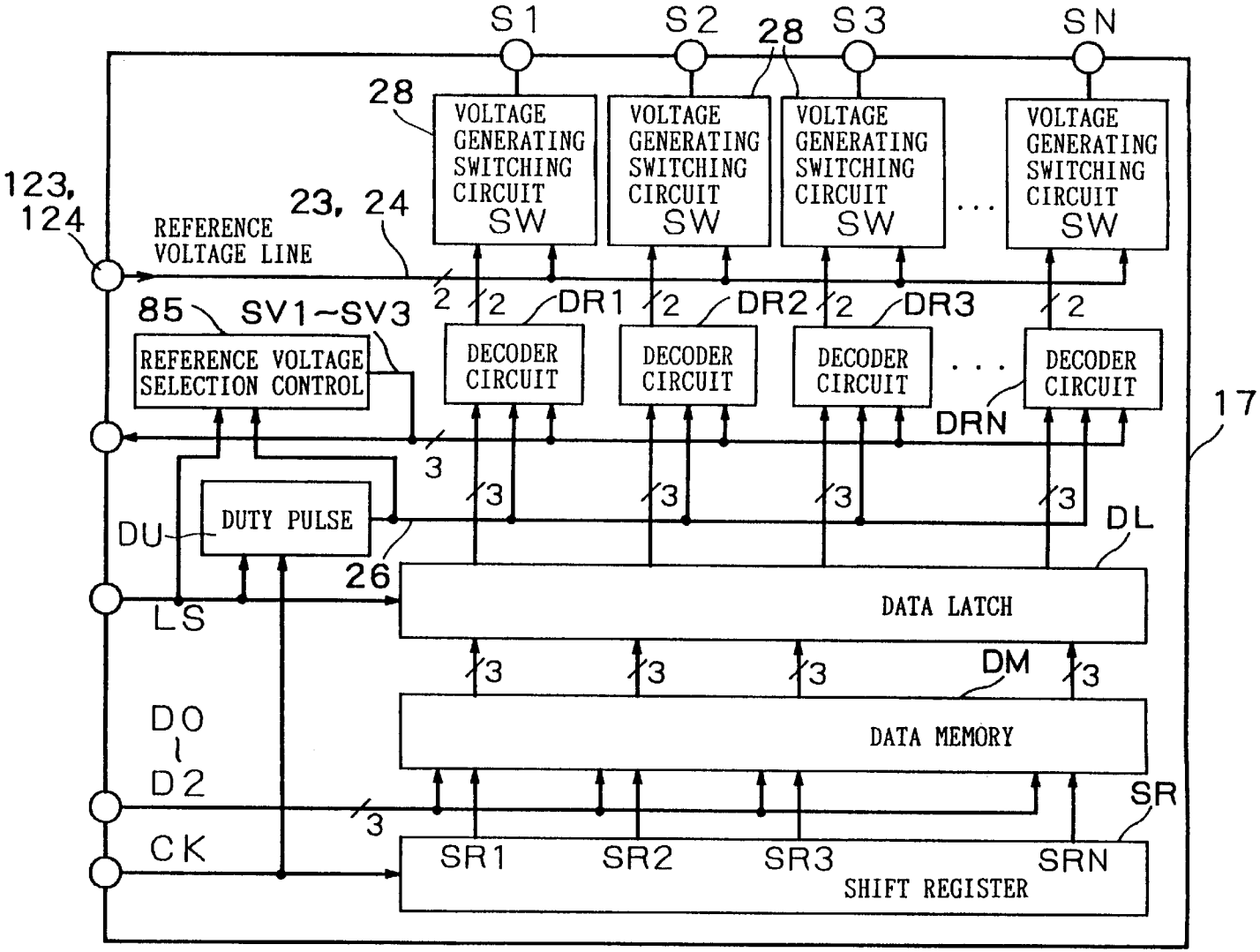
FIG. 2 is a block diagram showing a specific structure of a source driver 17 of FIG. 1.
Figure 12:
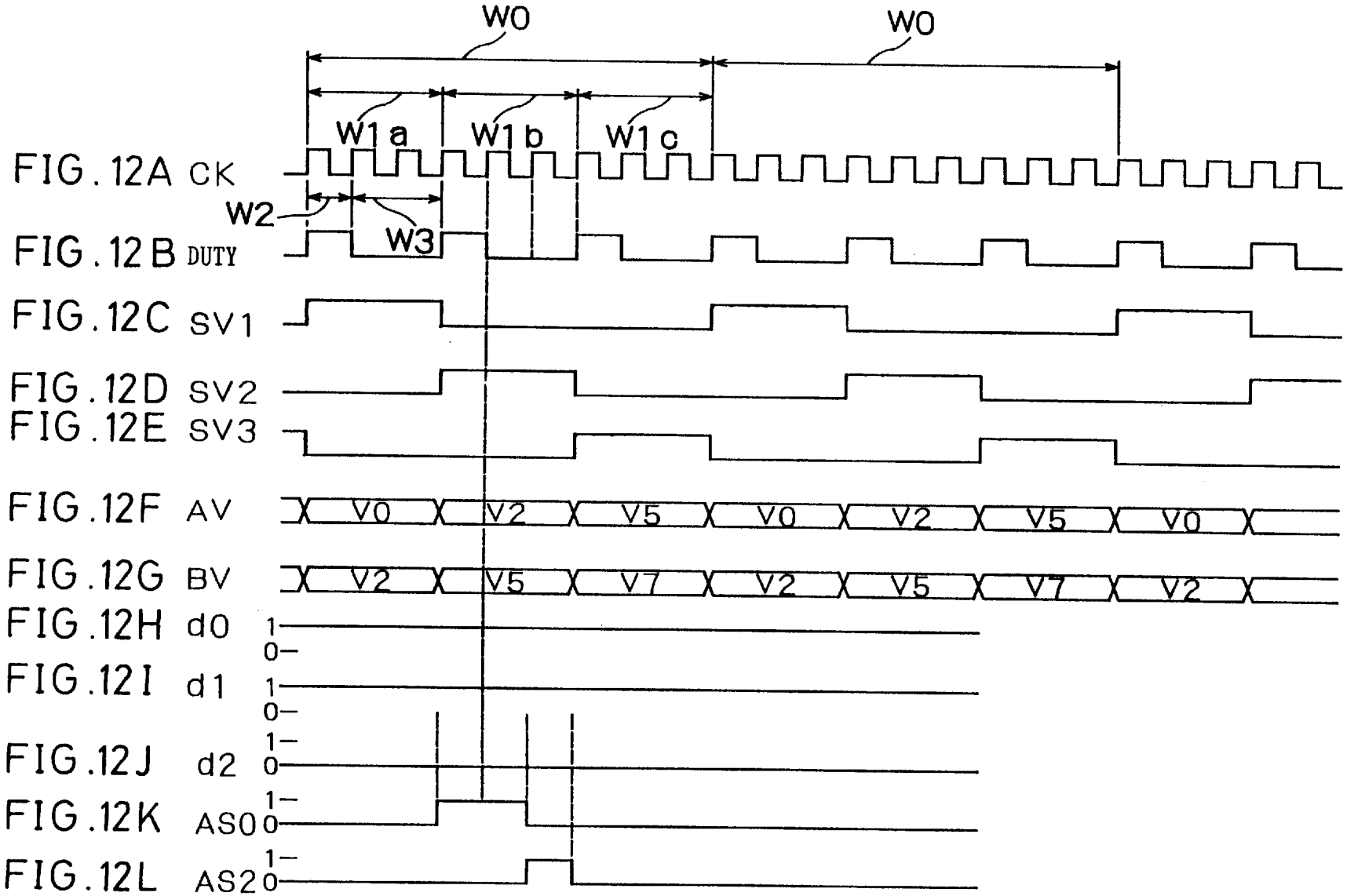
FIGS. 12A to 12L are views for describing an operation of supplying a driving voltage corresponding to gradation display to one source line 0i of the embodiment of the invention.

FIG. 2 is a block diagram showing a specific structure of the source driver 17. In FIG. 2, the reference numerals 2 and 3 each denote the number of the lines. Time-shared reference voltages are supplied to a voltage generating switching circuit 28 through the reference voltage lines 23 and 24 connected to a pair of input terminals 123 and 124. The clock signal CK (See FIG. 12A described later) is serially supplied to a shift register SR. Based on the clock signal CK, the shift register SR serially outputs memory control signals SR1, SR2, . . . SR(N−1), SRN for the respective source lines 01 to 0N which are respectively shown in FIGS. 3C to 3F. The gradation display data D0, D1 and D2 each consisting of serial three bits, supplied from the display control circuit 19 are serially supplied to the source driver 17 as denoted as DA1, DA2, DA3, . . . DAN in FIG. 3B in correspondence with the source lines 01 to 0N, and is serially stored in a data memory DM in response to the memory control signals SR1 to SRN.

In response to the latch signal LS which is outputted in each horizontal scanning period WH shown in FIG. 3G, a data latch circuit DL stores and latches gradation display data each consisting of parallel three bits which are stored in the data memory DM, in correspondence with the source lines 01 to 0N. Such an operation is performed in each horizontal scanning period WH of a horizontal synchronizing signal Hsyn which is used in the display control circuit 19 as shown in FIG. 3A.

Figures 4A, 4B, 4C, 4D, 4E, 4F, 4G, 4H:
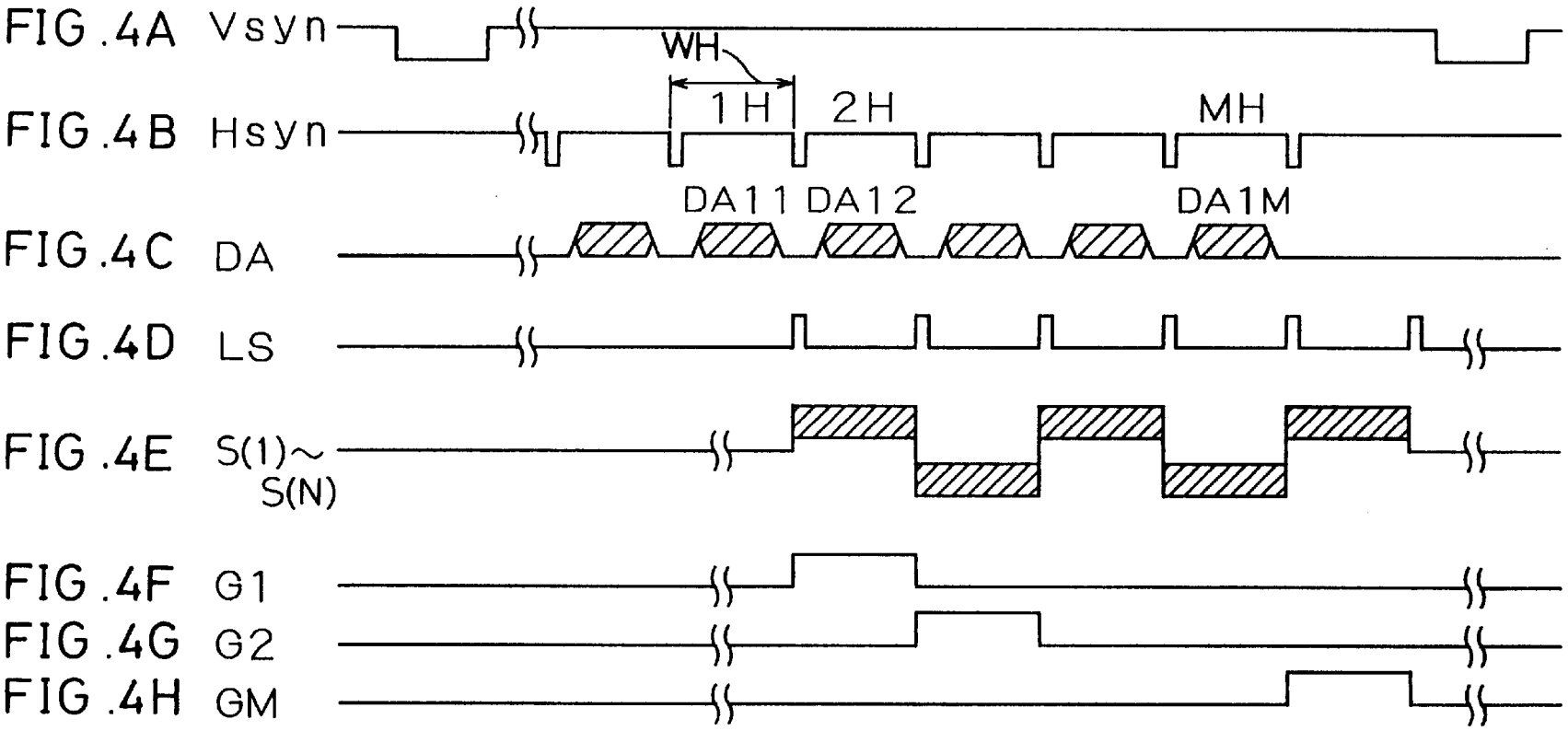
FIGS. 4A to 4H are views for describing an operation of one vertical scanning period in the embodiment.

FIGS. 4A to 4H are waveform diagrams for describing a timing operation in the display control circuit 19. During each cycle of a vertical synchronizing signal Vsyn shown in FIG. 4A, the horizontal synchronizing signal Hsyn shown in FIG. 4B is generated in correspondence with each one of the gate lines L1 to LM. In FIG. 4B, reference characters 1H, 2H, . . . , MH each denote the horizontal scanning period WH. During each horizontal scanning period WH, the display control circuit 19 generates gradation display data DA1 to DAN which are generally denoted at DA11, DA12, . . . , DA1M and which correspond to the source lines 01 to 0N, and supplies the gradation display data to the source driver 17. FIG. 4D shows a waveform of the latch signal LS which is generated in each horizontal scanning period WH.

FIG. 4E generally shows a voltage level which is supplied to the source lines 01 to 0N in accordance with the digital gradation display data D0 to D2 supplied in one horizontal scanning period WH, and in order to show an overall voltage level of the in total M source lines 01 to 0N, hatching is applied. One screen picture of the display panel 16 is displayed in one vertical scanning period in the non-interlace method. Thus, the invention is also applicable to the non-interlace method.

FIGS. 4F to 4H show the waveforms of the gate signals G1, G2 and GM, respectively, which are respectively supplied to the gate lines L1, L2 and LM from the gate driver 18. For example, when the j-th gate signal Gj is at the high level, in total N thin film transistors T (j, i) (j=1 to M, i=1 to N) which have gate electrodes connected to the gate line Lj are all turned on, whereby each of the pixel electrodes P (j, i) are charged up in accordance with a driving voltage which is supplied to the source line 0i. This operation is repeated for M times in total for each one of the gate lines L1 to LM so that one screen picture in one vertical scanning period of the non-interlace method is displayed.

Figure 29:
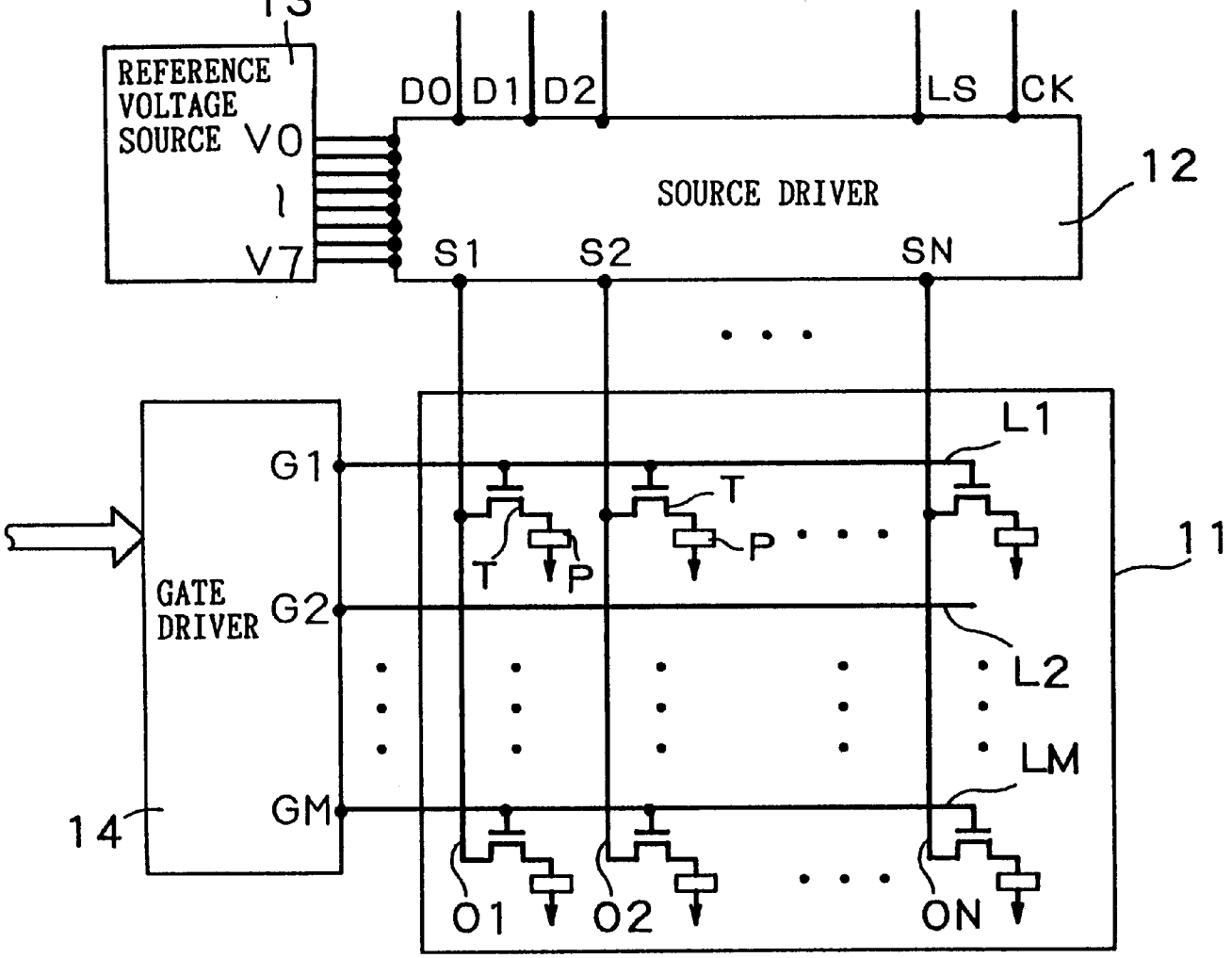
FIG. 29 PRIOR ART
FIG. 29 is a simplified block diagram showing an overall structure of a driving apparatus of a display apparatus of prior art.
Figure 30:
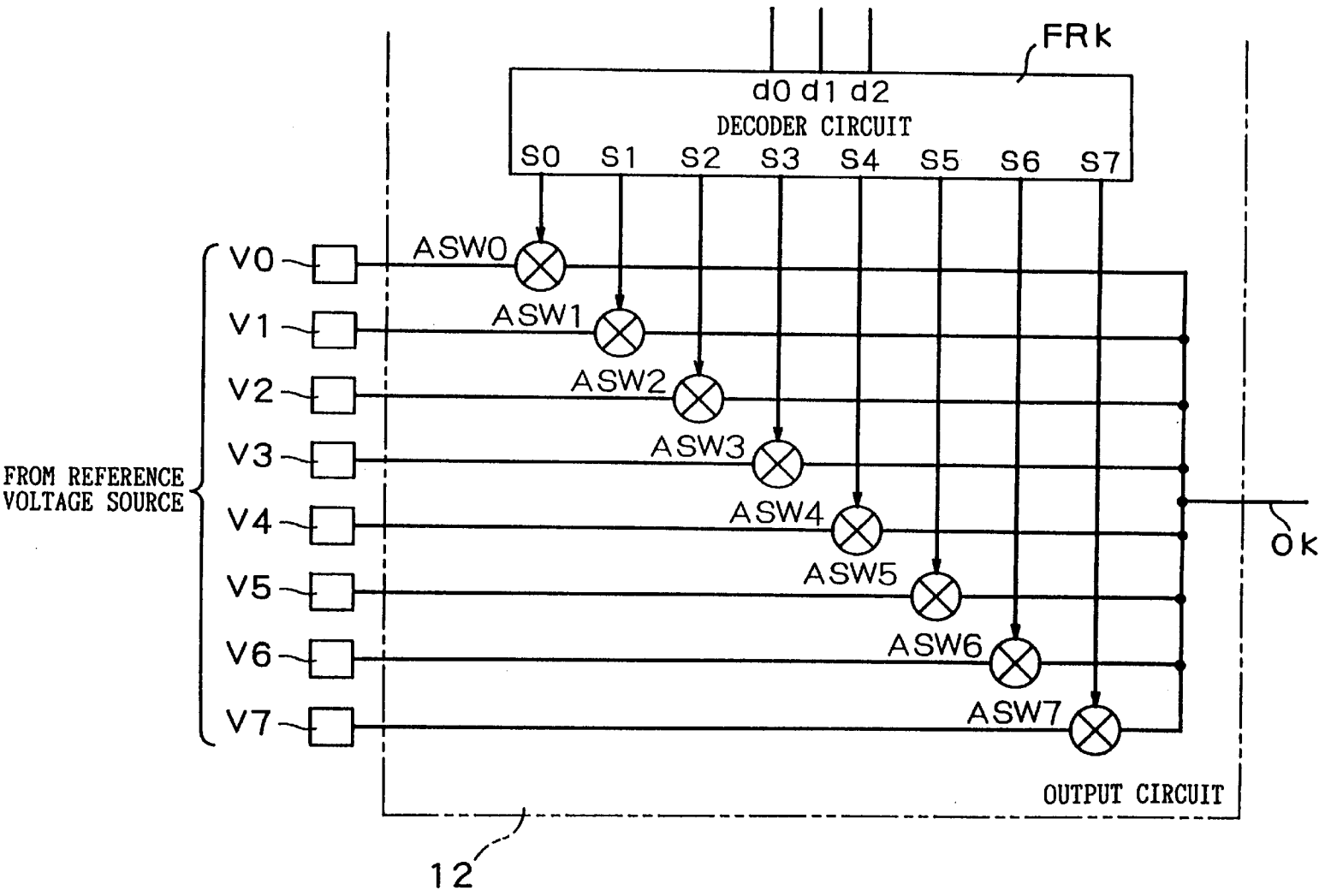
FIG. 30 PRIOR ART
FIG. 30 is a block diagram partially showing a specific structure of a source driver 12 of prior art of FIG. 29.
Figure 31:
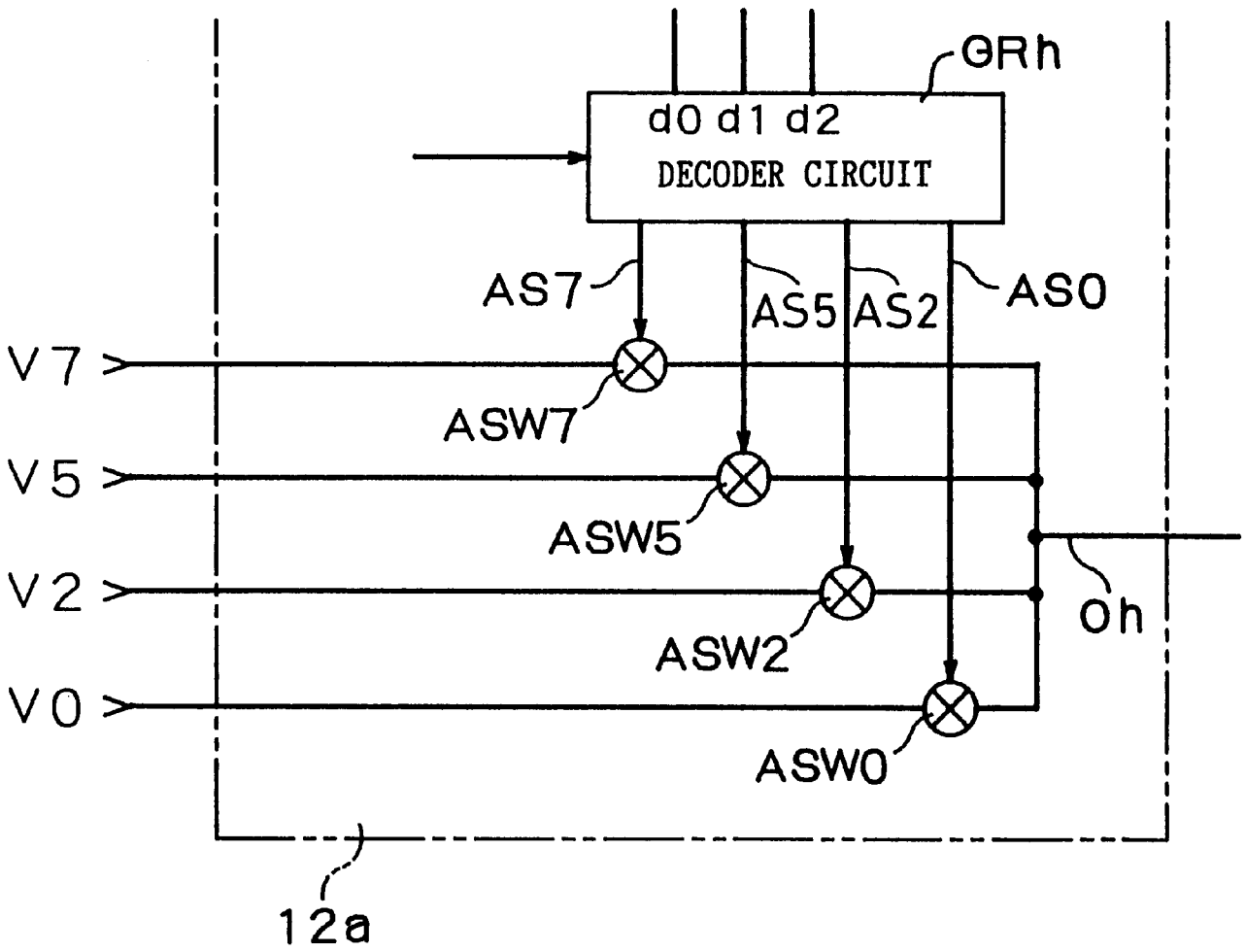
FIG. 31 PRIOR ART
FIG. 31 is an electric circuit diagram partially showing a specific structure of a source driver 12*a* of another prior art.
Figures 32A, 32B, 32C:
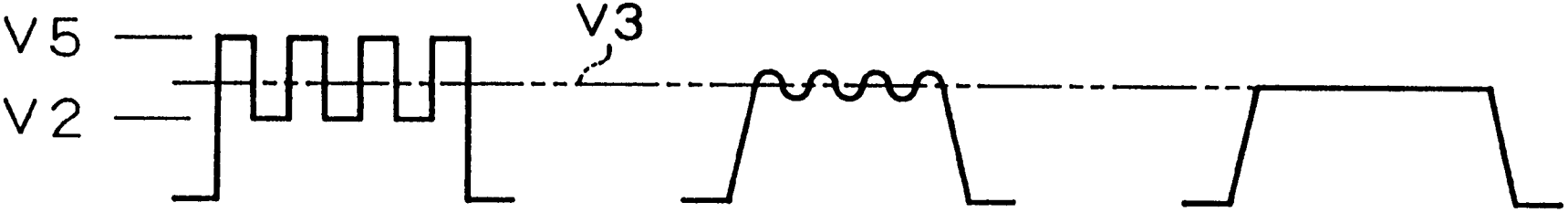
FIG. 32A PRIOR ART
FIG. 32B PRIOR ART
FIG. 32C PRIOR ART
FIGS. 32A to 32C are waveform diagrams for describing a n operation of generating a voltage V3 which is obtained by averaging with vibrating voltages using reference voltages V2 and V5 of the prior art of FIG. 31.

FIGS. 5A to 5M are waveform diagrams showing that a driving voltage supplied to the source lines 01 to 0N triggers a displaying operation in the above embodiment of the invention. FIG. 5A shows a vertical synchronizing signal Vsyn, FIG. 5B shows the horizontal synchronizing signal Hsyn. As FIG. 4D described earlier, FIG. 5C shows the latch signal LS. FIG. 5D comprehensively shows a voltage level supplied to the source lines 01 to 0N for each horizontal scanning period WH, which is the same as the earlier description on FIG. 4E. FIGS. 5E, 5F and 5G, which respectively correspond to afore-described FIGS. 4F, 4G and 4H show the gate signals G1, G2 and GM, respectively. FIGS. 5H to 5M show waveforms of voltages which are held in the respective pixel electrodes P (j, i) (j=1 to M, i=1 to N) of the display panel 11 of FIG. 29. The polarity of a voltage supplied to each pixel electrode is reversed every vertical scanning period, that is, for every field by the ac driving method so that deterioration of the liquid crystal is suppressed.

Figure 6:
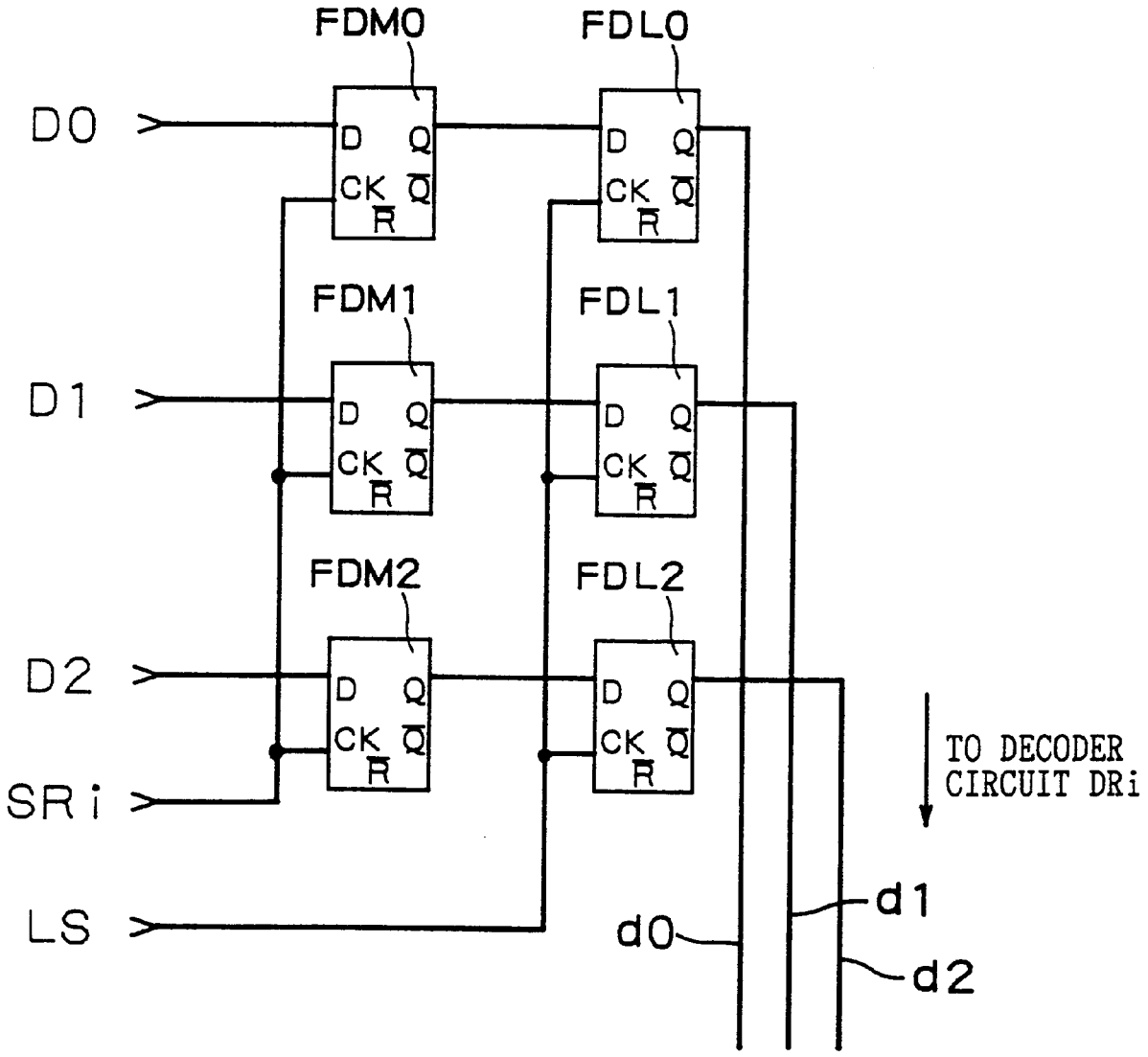
FIG. 6 is a block diagram showing a specific structure of a data memory DMi and a data latch circuit DLi which correspond to one source line 0i.

FIG. 6 is a block diagram showing a specific structure of the data memory DM and the data latch circuit DL corresponding to one source line 0i. In the data memory DMi corresponding to the i-th source line 0i, the respective bits of the gradation display data D0 to D2 are supplied to input terminals D of D-type flip-flops FDM0 to FDM2, and levels at a time when a shift signal SRi is supplied to clock input terminals CK are outputted at terminals Q.

A data latch circuit DLi comprises D-type flip-flops FDL0 to FDL2 which receive at input terminals D outputs Q from the D-type flip-flops FDM0 to FDM2 of the data memory DMi. The latch signal LS is supplied to the clock input terminals CK of the D-type flip-flops FDL0 to FDL2, and levels at the input terminals D at this point are supplied in the form of three parallel bits as the gradation display data d0 to d2 to the decoder circuit DRi from the output terminal Q.

Figure 7:
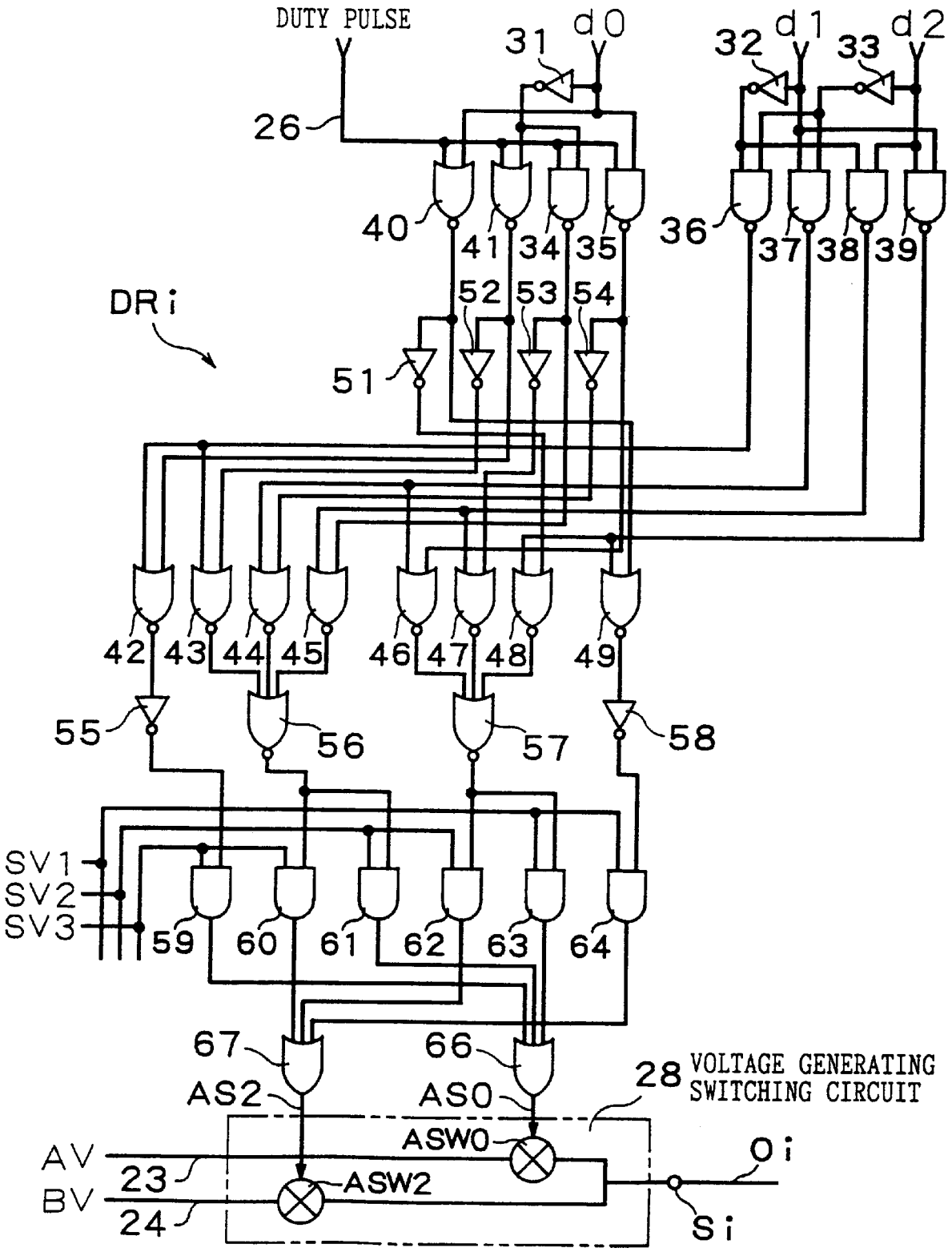
FIG. 7 is a block diagram showing a specific structure of a decoder circuit DRi and a voltage generating switching circuit 28 which correspond to one source line 0i.

FIG. 7 is an electric circuit diagram showing a specific structure of the decoder circuit DRi which corresponds to one source line 0i and which receives the gradation display data d0 to d2 which are outputted from the data latch circuit DLi of FIG. 6. FIG. 7 also shows a voltage generating switching circuit 28 which makes it possible to supply the driving voltages V0 to V7 to the source line 0i.

The decoder circuit DRi receives the gradation display data d0 to d2 each consisting of parallel three bits while receiving a duty pulse which is outputted from a duty pulse generating circuit DU through a line 26. The gradation display data d0 to d2 and signals reversed by reverse circuits 31, 32 and 33 for reversing the gradation display data d0 to d2 are supplied to NAND gates 34 to 39 and NOR gates 40 and 41. The duty pulse is supplied to the NAND gates 34 and 35 and the NOR gates 40 and 41 through the line 26. Outputs from the NAND gates 34 to 39 and the NOR gates 40 and 41 and signals reversed by reverse circuits 51 to 54 for reversing these outputs are supplied to NOR gates 42 to 49. An output from the NOR gate 42 is reversed by a reverse circuit 55, outputs from the NOR gates 43 to 45 are supplied to a NOR gate 56, outputs from the NOR gates 46 to 48 are supplied to a NOR gate 57, while an output from the NOR gate 49 is reversed by a reverse circuit 58.

The three reference voltage control signals SV1, SV2 and SV3 are supplied to one inputs of AND gates 59, 60; 61, 62; 63, 64. An output from the reverse circuit 55 is supplied to the other input of the AND gate 59. An output from the NOR gate 56 is supplied to the other inputs of the AND gates 60 and 61. An output from the NOR gate 57 is supplied to the other inputs of the AND gates 62 and 63. An output from the reverse circuit 58 is supplied to the other input of the AND gate 64.

Outputs from the AND gates 59, 61 and 63 are supplied from an OR gate 66 to an analog switch ASW0 which serves as a voltage generating switching element of the voltage generating switching circuit 28, as a switching control signal ASO. Outputs from the AND gates 60, 62 and 64 are supplied from another OR gate 67 to an analog switch ASW2 which serves as another voltage generating switching element, as the switching control signal AS2.

Figure 8:
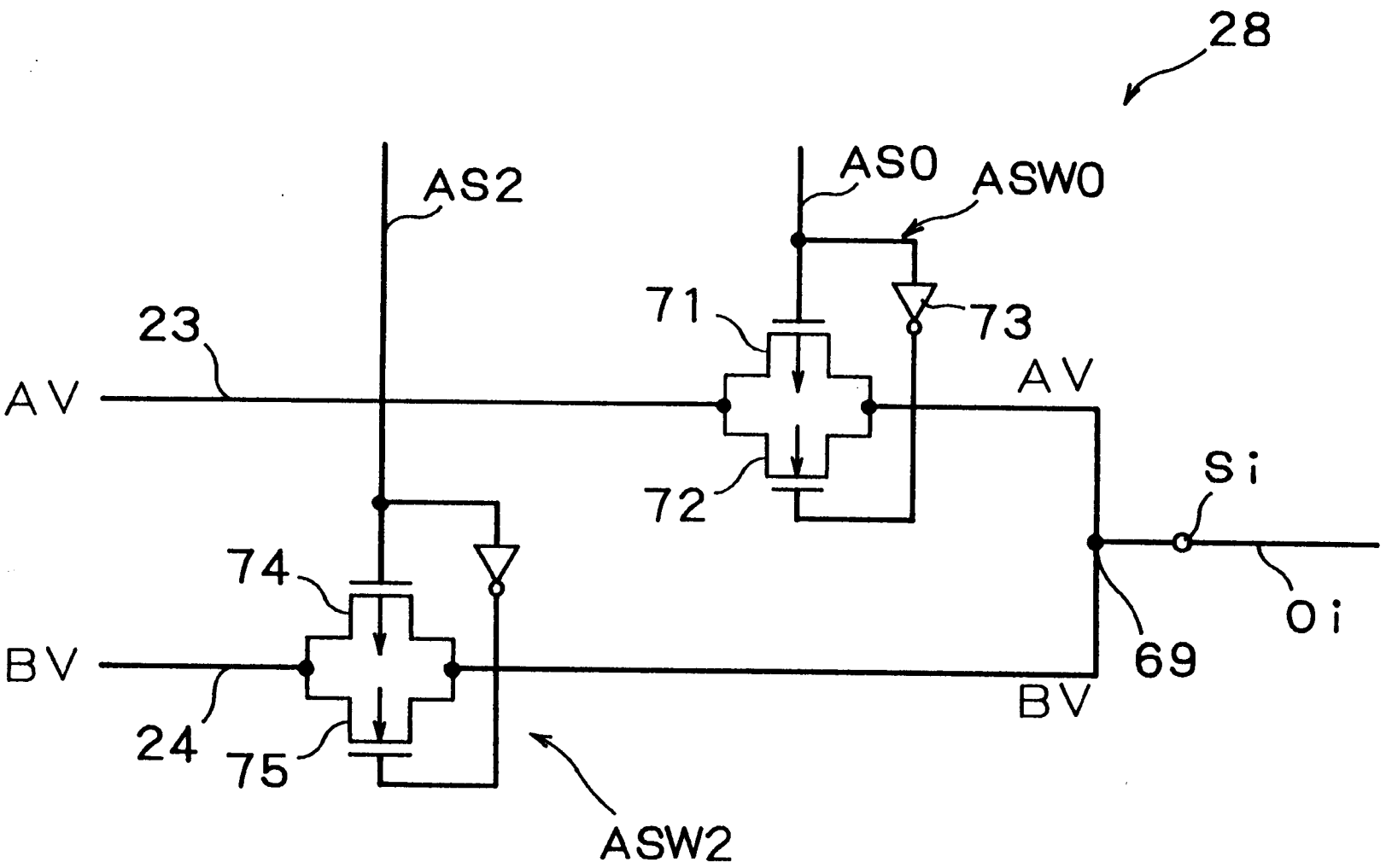
FIG. 8 is an electric circuit diagram showing specific structures of analog switches ASW0 and ASW2 which are included in the voltage generating switching circuit 28.

FIG. 8 is an electric circuit diagram showing a specific structure of the voltage generating switching circuit 28. The analog switches ASW0 and ASW2 are inserted in the two reference voltage lines 23 and 24. The reference voltage lines 23 and 24 are connected in common at a connection point 69 on one side (i.e., on the right-hand side in FIG. 8) of the analog switches ASW0 and ASW2, while connected from a input connection terminal Si to the i-th source line 0i to supply the driving voltages V0 to V7 which are needed for gradation display. The analog switch ASW0 includes field effective transistors 71 and 72 having a P-type channel and an N-type channel which are connected in parallel to each other and a reverse circuit 73 which reverses and supplies the switching control signal ASO to a gate of the transistor 72. The switching control signal ASO is directly supplied to a gate of the transistor 71. In a similar manner, another analog switch ASW2 includes a P-type channel field effective transistor 74 whose gate receives the switching control signal AS2 and an N-type channel field effective transistor 75 whose gate receives the switching control signal AS2 through a reverse circuit 76. The transistors 74 and 75 are connected parallel to each other.

To supply selected reference voltage levels to the source line 0i and accurately hold voltage levels at the pixel electrodes P, the analog switches ASW0 and ASW2 must each have a sufficiently low ON-state resistance. Hence, the transistors 71, 72;74, 75 must each have a relatively large size. In this embodiment, to realize 8-level gradation display using the gradation display data D0 to D2 each consisting of three bits, only two analog switches ASW0 and ASW2 are necessary. The analog switches ASW0 and ASW2 occupy a reduced area in the source driver 17, which in turn reduces the size of the semiconductor chip of the source driver 17. Further, only two reference voltage lines 23 and 24 are necessary, which in turn reduces the number of input connection terminals AV and BV of the source driver 17.

Figure 9:
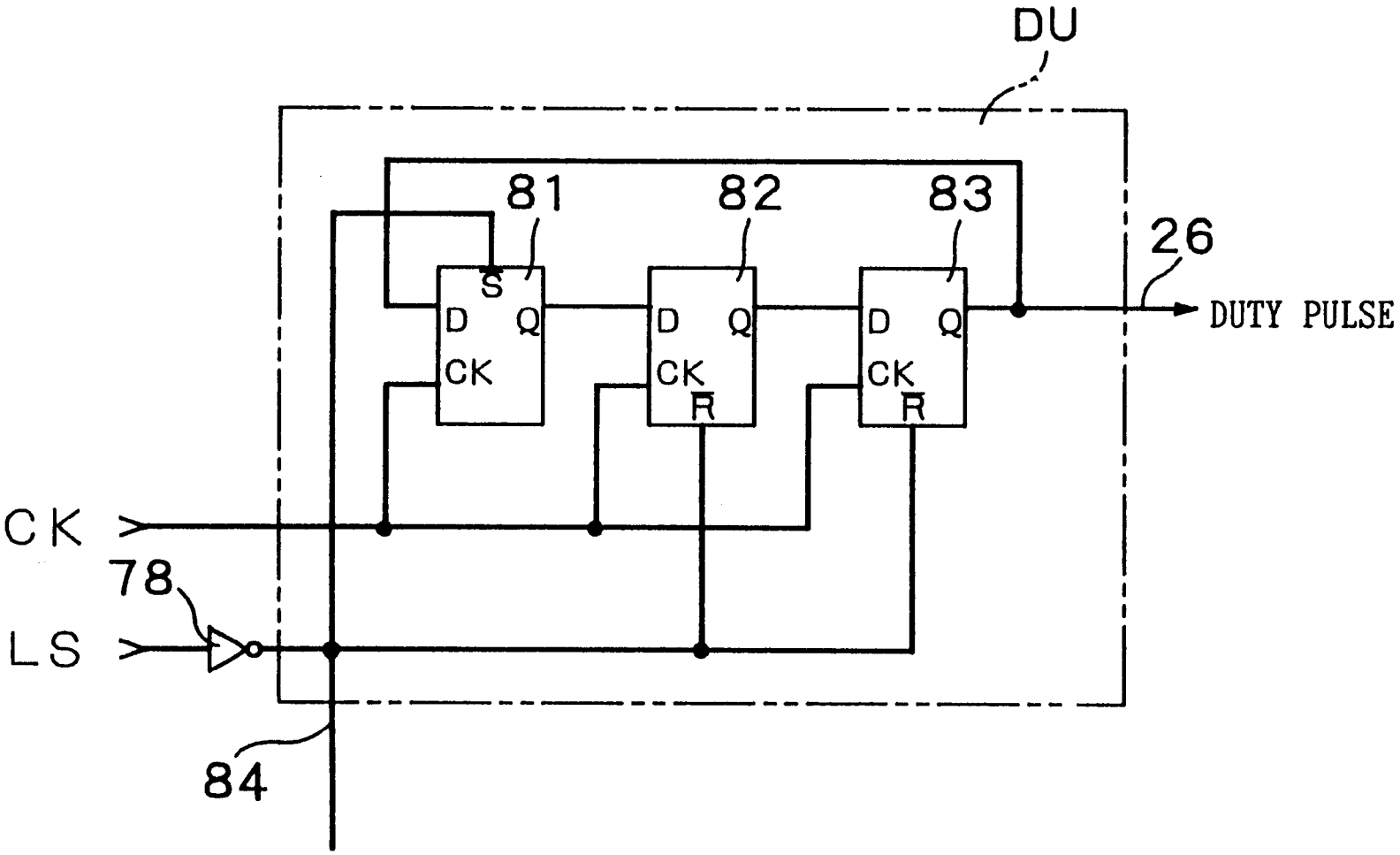
FIG. 9 is a block diagram showing a specific structure of a duty pulse generating circuit DU.

FIG. 9 is a block diagram showing a specific structure of the duty pulse generating circuit DU. The duty pulse generating circuit DU generates a duty pulse having a duty ratio of 1:2 as shown in FIG. 12B, in response to the clock signal CK of FIG. 12A which will be described later and a signal which is obtained by reversing the latch signal LS by a reverse circuit 78 and which is supplied through a line 84. The duty pulse generating circuit DU is formed by connecting D-type flip-flops 81, 82 and 83 in series to each other or in a cascade configuration. The clock signal CK is supplied to clock input terminals of the flip-flops 81, 82 and 83. The signal obtained by reversing the latch signal LS by the reverse circuit 78 is supplied to a set input terminal S* (the symbol * denotes reversing) of the first flip-flop 81. An output Q from the last flip-flop 83 is supplied to the input terminal D of the first stage.

The duty pulse is commonly supplied to the decoder circuits DRi through the line 26 as described earlier and also to a device for controlling reference voltage selection 85 as described immediately below.

Figure 10:
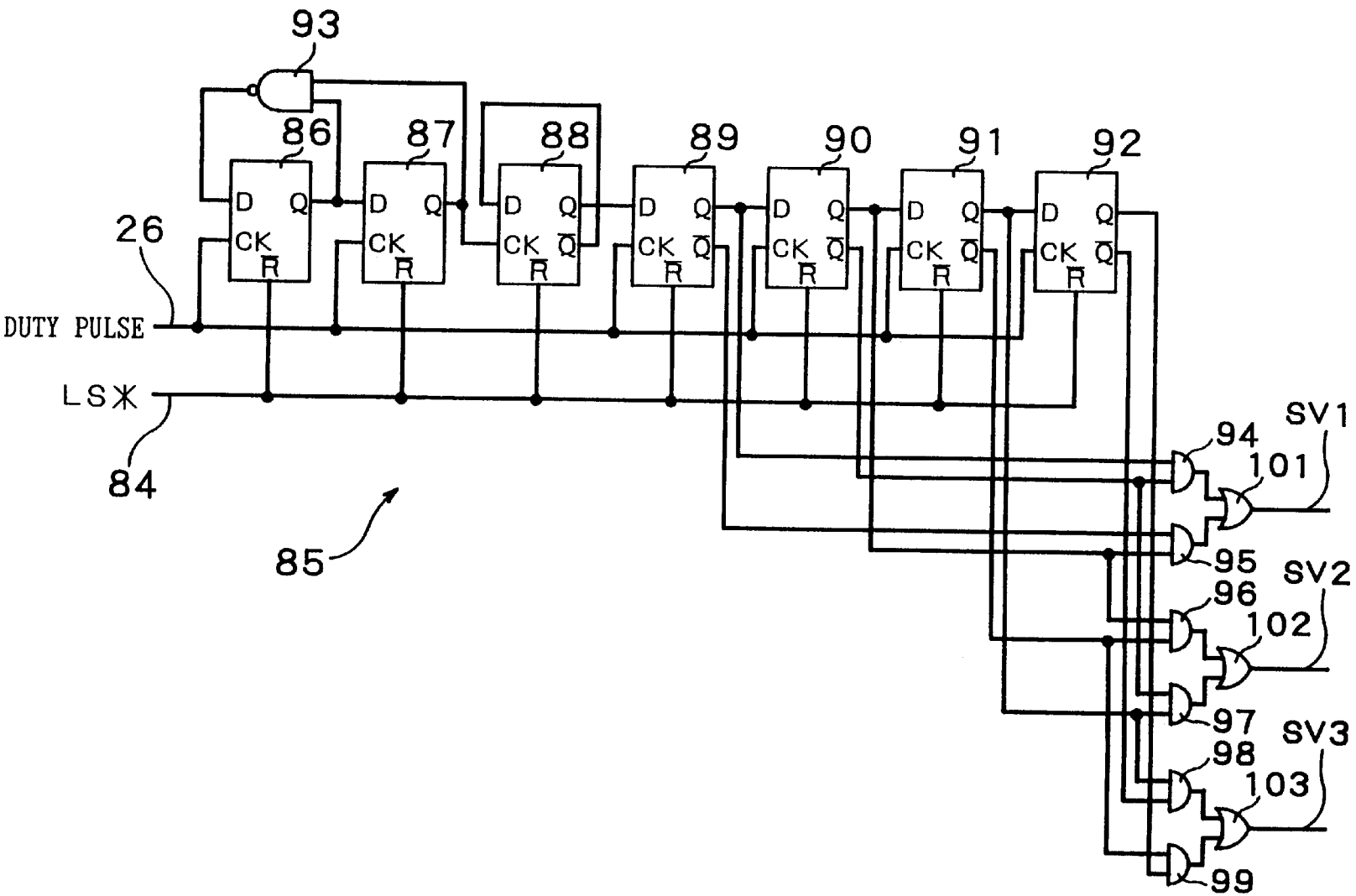
FIG. 10 is a block diagram showing a specific structure of control means for controlling reference voltage selection 85.

FIG. 10 is a block diagram showing a specific structure of the device for controlling reference voltage selection 85. The reference voltage control signals SV1, SV2 and SV3 are obtained as shown in FIGS. 12C, 12D and 12E. The duty pulse is commonly supplied from the line 26 to the clock input terminals CK of D-type flip-flops 86 to 92 which are connected in series to each other or in a cascade configuration. A latch signal LS* from the reverse circuit 78 through the line 84 is commonly supplied to reset input terminals R* of the flip-flops 86 to 92. Outputs Q from the first flip-flop 86 and the next flip-flop 87 are supplied to a NAND gate 93, and an output from the NAND gate 93 is supplied to the input terminal D of the first flip-flop 86.

Figure 11:
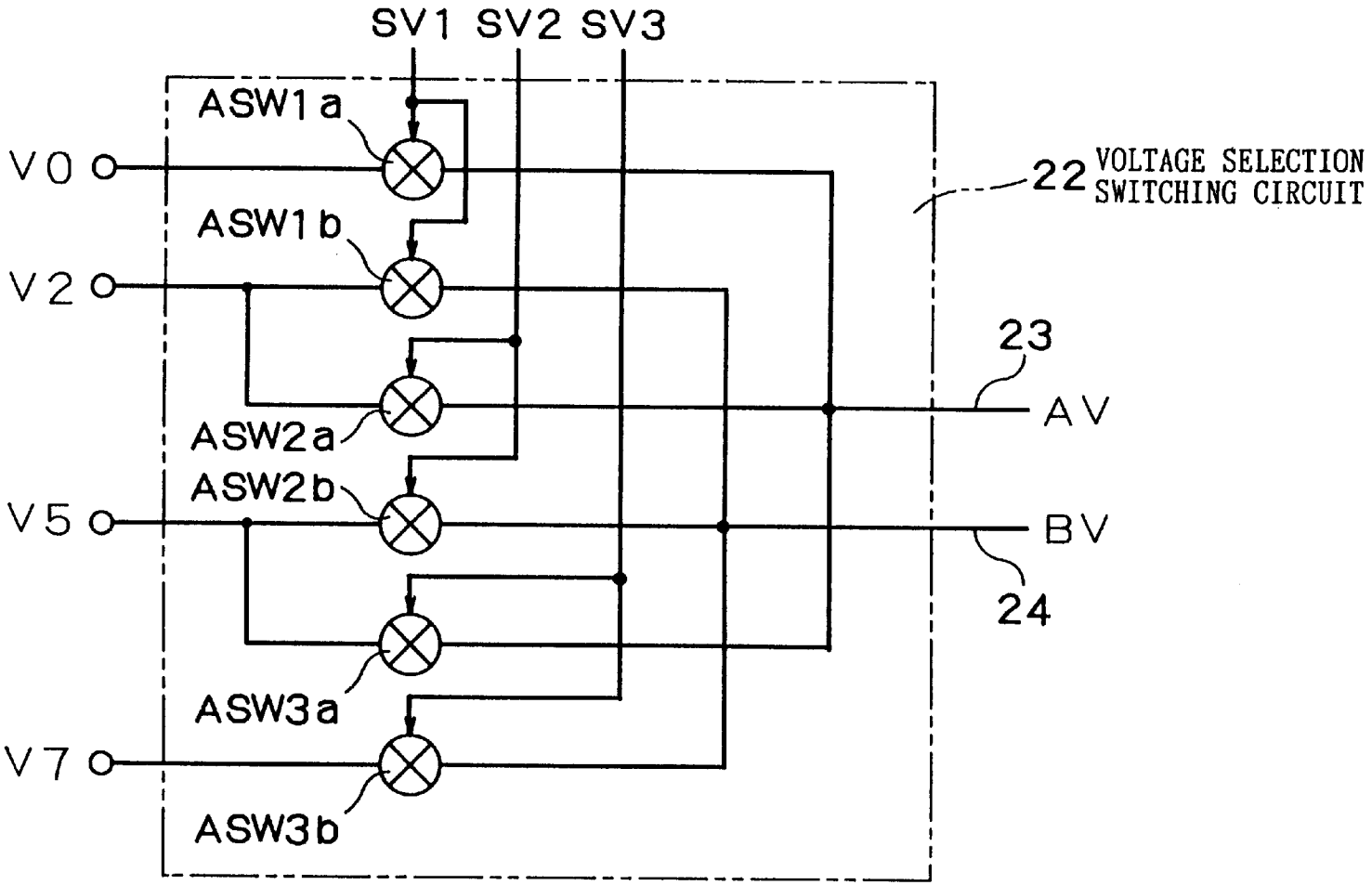
FIG. 11 is an electric circuit diagram showing a specific structure of a voltage selection switching circuit 22.

Outputs Q and Q* from the flip-flops 89 to 92 are supplied to AND gates 94, 95; 96, 97; 98, 99 for the reference voltage control signals SV1, SV2 and SV3, and further to NOR gates 101, 102 and 103. FIG. 11 is a block diagram showing a specific structure of the voltage selection switching circuit 22 of FIG. 1. Analog switches ASW1*a*, ASW1*b*; ASW2*a*, ASW2*b*; ASW3*a*, ASW3*b* which serve as switching elements for selecting a reference voltage are interposed between input terminals for inputting the reference voltages V0, V2, V5 and V7 from the reference voltage source 21 and the other side of the two reference voltage lines 23 and 24. The analog switches ASW1*a* to ASW3*b* turn on and off under the control of the reference voltage control signals SV1, SV2 and SV3. For example, when the reference voltage control signal SV1 turns to the high level in the first time period W1a (See FIGS. 12A to 12L), the analog switches ASW1*a* and ASW1*b* turn on, thereby supplying the reference voltages V0 and V2 to the reference voltage lines 23 and 24. Similarly, when the reference voltage control signal SV2 is supplied to the analog switches ASW2*a* and ASW2*b* in the first time period W1b, the reference voltages V2 and V5 are supplied to the reference voltage lines 23 and 24. Further, when the reference voltage control signal SV3 is supplied to the analog switches ASW3*a* and ASW3*b* in the first time period W1c, the reference voltages V5 and V7 are supplied to the reference voltage lines 23 and 24. Thus, the multiple value voltage generation device is formed by the reference voltage source 21, the voltage selection switching circuit 22 and the reference voltage selection controlling device 85.

As described before, the combinations of the reference voltages supplied from the reference voltage lines 23 and 24 for the respective first time periods W1a, W1b and W1c are (V0, V2), (V2, V5) and (V5, V7). Thus, the combinations consist of vertically adjacent reference voltages V0 and V2, V2 and V5, and V5 and V7. Further, the voltage values forming these three combinations (V0, V2), (V2, V5) and (V5, V7) are different between the combinations.

FIGS. 12A to 12L are views for describing voltages which are supplied to the source line 0i through the voltage generating switching circuit 28. In accordance with the clock signal CK of FIG. 12A, the duty pulse generating circuit 26 generates the duty pulse of FIG. 12B which is synchronized with the latch signal LS as well. On the basis of this duty pulse and the latch signal LS, the device for controlling reference voltage selection 85 of FIG. 10 generates the three reference voltage control signals SV1, SV2 and SV3. The reference voltage control signals SV1, SV2 and SV3 are as shown in FIGS. 12C, 12D and 12E, respectively. Hence, in response to the reference voltage control signals SV1, SV2 and SV3, the voltage selection switching circuit 22 outputs the reference voltages V0, V2, V5; V2, V5, V7 which are shown in FIGS. 12F and 12G, respectively, to the reference voltage lines 23 and 24. Thus, the reference voltage control signals SV1, SV2 and SV3 are shifted from each other by the first time period W1. Hence, the combinations of the reference voltages (V0, V2), (V2, V5) and (V5, V7) are time-shared by the first time period W1 and outputted. The reference character W1 may generally denote the first time periods W1a, W1b and W1c. The duty pulse has a duty ratio of 1:2 which has a high level and a low level which respectively correspond to second time periods W2 and W3 which are each shorter than the first time period W1.

$$W1=W2+W3 \tag{1}$$

$$W3=2\cdot W2 \tag{2}$$

The combinations of the reference voltages (V0, V2), (V2, V5) and (V5, V7) are repeated for each of first time period W1a, W1b and W1c in serial. The sum of the first time periods W1a, W1b and W1c is denoted as W0. In this embodiment, the periods W1a, W1b and W1c are equal to each other.

$$W0=3\cdot W1 \tag{3}$$

The cycle W0 for repeating the three combinations of the reference voltages may be equal to one horizontal scanning period WH or shorter than one horizontal scanning period WH. In the embodiment above, the three first time periods W1a, W1b and W1c included in the periodical time period W0 are set equal to each other. However, the three first time periods W1a, W1b and W1c may be different from each other in other embodiments.

To supply the reference voltage V0 or V2 in the first time period W1a, it is only necessary that the analog switches ASW1*a* and ASW1*b* are conductive and the analog switch ASW0 or ASW2 of the voltage generating switching circuit 28 inserted in the reference voltage lines 23 and 24 remains conductive in the first time period W1a. When the reference voltage V2 needs to be supplied in the first time period W1b, it is only necessary that the analog switches ASW2*a* and ASW2*b* are both conductive and the analog switch ASW0 of the voltage generating switching circuit 28 stays conductive in the first time period W1b. This is the same with the other reference voltages V5 and V7.

Table 1 shows the reference voltages V0, V2, V5 and V7 corresponding to the gradation display data D0 to D2, i.e., latched gradation display data d0 to d2 from the data latch circuit DL, and shows voltages V1, V3, V4 and V6 which are generated by the voltage generating switching circuit 28. For example, when the reference voltage V7 is set larger than the reference voltage 10, $$V0<V1<V2<V3<V4<V5<V6<V7 \quad (4)$$

TABLE 1

| Gradation Display Data | | | |
|---|---|---|---|
| D3 | D1 | D0 | Output Voltage Value |
| 0 | 0 | 0 | V0 |
| 0 | 0 | 1 | $V1=\frac{V0+2\cdot V2}{3}$ |
| 0 | 1 | 0 | V2 |
| 0 | 1 | 1 | $V3=\frac{2\cdot V2+V5}{3}$ |
| 1 | 0 | 0 | $V4=\frac{V2+2\cdot V5}{3}$ |
| 1 | 0 | 1 | V5 |
| 1 | 1 | 0 | $V6=\frac{2\cdot V5+V7}{3}$ |
| 1 | 1 | 1 | V7 |

For example, it is assumed that the gradation display data d0, d1 and d2 are outputing from the data latch circuit DLi with respect to one source line 0i and supplied to the decoder circuit DRi of FIG. 7. It is also assumed that the voltage V3 is to be generated using the reference voltages V2 and V5. The latched gradation display data d0 to d2 are expressed as logical "110" in one horizontal scanning period as shown in FIGS. 12H, 12I and 12J.

Hence, in the period W1b in which the reference voltage control signal SV2 which causes the combination (V2, V5) of the reference voltages V0, V2, V5 and V7 to be supplied in one cycle W0 remains at the high level, the OR gate 66 of the decoder circuit DRi of FIG. 7 outputs the switching control signal ASO which has a waveform as that shown in FIG. 12K. The OR gate 67 outputs the switching control signal AS2 shown in FIG. 12L. The period W3 when the reference voltage V2 is supplied to the source line 0i to generate the voltage V3 is twice as long as the period W2 when the reference voltage V5 is supplied. The voltage V3 is supplied to the pixel electrodes P through the source line 0i in this manner, whereby gradation display is realized by a charged voltage which corresponds to the voltage V3.

Figure 13:
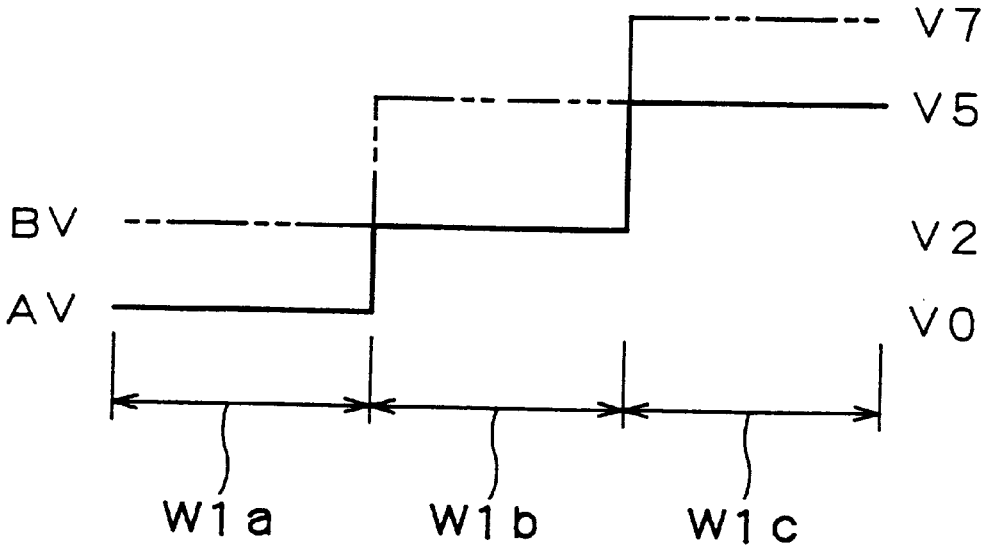
FIG. 13 is a view for describing an operation of supplying reference voltages V0V2, V5 and V7 to reference voltage lines 23 and 24 in each one of first time periods W1a, W1b and W1c.

Voltages supplied to the reference voltage lines 23 and 24 from the voltage selection switching circuit 22 are as shown in FIG. 13 for the respective first time periods W1a, W1b and W1c.

In the reference voltage selection switching circuit 22 described in relation to FIG. 11, the plural (four in this embodiment) reference voltages V0, V2, V5 and V7 are respectively supplied to the input terminals 123 and 124 of the source driver 17 through the reference voltage lines 23 and 24 in time sharing mode in sequence of from low to high or from high to low of the plural reference voltages V0, V2, V5 and V7 (from low to high in this embodiment) in the first time periods W1a, W1b, W1c, . . . , W1d of the cycle W0, respectively, which is repeated in plural times (three times in this embodiment). The reference voltages V0, V2, V5 and V7 respectively supplied to the pair of input terminals 123 and 124 through the reference voltage lines 23 and 24 at one time in the respective first periods W1a, W1b and W1c are shifted in sequence of from low to high of the reference voltages by one reference voltage from each other. In the embodiment described above, the reference voltages V0, V2 and V5 of the reference voltages V0, V2, V5 and V7 are supplied in this order to the reference voltage line 23, and the reference voltages V2, V5 and V7, which are shifted by one reference voltage in sequence of from low to high of the reference voltages, are supplied in this order to the reference voltage line 24.

Although one cycle W0 consisting of the three first time periods W1a, W1b and W1c may be repeated in plural times in one horizontal scanning period WH and voltages may be applied to and held at the respective source lines 0i, in the case where charging up of voltages corresponding to such levels of gradation by the pixel electrodes P is achieved only in one cycle W0 , such application of voltages may be performed only once.

Figure 14:
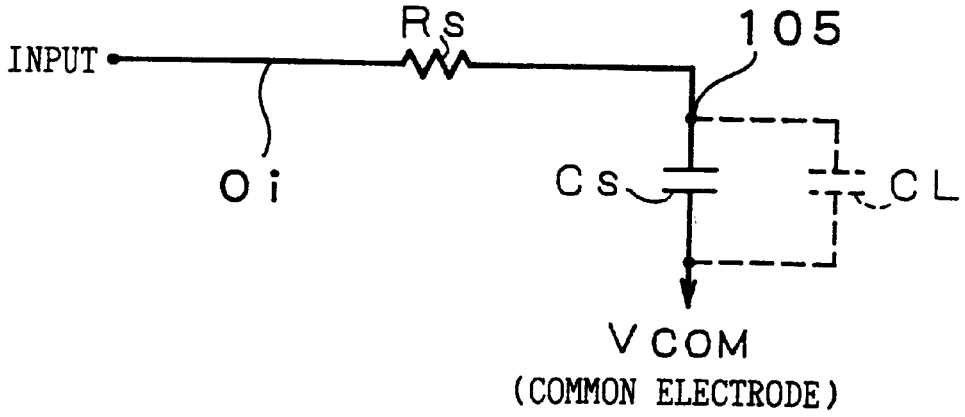
FIG. 14 is an equivalent circuit diagram of an electric circuit for describing a voltage generated from a vibrating voltage, which is supplied to the pixel electrode P.

FIG. 14 is an equivalent circuitry diagram which is simplified to describe the principles of the invention. The invention considers a circuit serving as a so-called low pass filter in which a resistor Rs of one source line 0i which is to be driven by the source driver 17 and a static capacity Cs of the source line 0i are connected in series to each other. An equivalent capacity of a pixel electrode P is denoted at the reference character CL. The static capacity CL of the pixel electrode P is sufficiently smaller than the capacity Cs of the source line 0i (Cs>>CL). Hence, a voltage supplied to the pixel electrode P has the same value as a voltage which is present at a connection point 105 between the resistor Rs and the static capacity Cs. Hence, in this equivalent circuit of FIG. 14 which serves as a low pass filter, when the analog switches ASW0 and ASW2 of the voltage generating switching circuit are intermittently turned on and off for the second time periods W2 and W3 in the first time periods W1a, W1b and W1c to supply a so-called vibrating voltage v(t) which depends on a time t to the source line 0i, by setting the cycle 2 of the vibrating voltage v(t) sufficiently shorter than the cycle of the shut-off frequency of the low pass filter which is determined by the resistor Rs and the static capacity Cs, a charged voltage at the pixel electrode P becomes sufficiently close to an average voltage of the periodic vibrating voltage v(t) which is applied on the pixel electrode P at the connection point 105. For instance, where a time constant satisfies Cs Rs=$10^{-7}$, the frequency of the vibrating voltage only needs to be 1.6 MHz or more.

Thus, according to the invention, positively utilizing the resistor Rs and the static capacity Cs of the source line 0i which are inherent in the liquid crystal display panel 16, based on the pre-selected four types of the reference voltages V0, V2, V5 and V7, intermediate voltages V1, V3, V4 and V6 are generated as shown in the aforementioned Table 1. This not only simplifies the structure of the reference voltage source 21 but also reduces the number of the reference voltage lines 23 and 24 and hence the input connection terminals of the source driver 17 which is realized by a semiconductor integrated circuit. This also reduces the number of the analog switches ASW0 and ASW2 which are disposed separately for the reference voltage lines 23 and 24 to serve as the voltage generating switching elements. In the embodiment above, the number of these analog switches is 2, thereby reducing the size of the semiconductor chip.

The inventor of the invention has confirmed that the area size of the semiconductor chip forming the source driver 17 used in the invention is reduced by about 10% according to the embodiment shown in FIGS. 1 to 14 as compared with the conventional chips described referring to FIGS. 29 to 32. Further, the inventor of the invention has confirmed that the semiconductor chip size is reduced by about 15% as compared with the conventional chips in the case of 64-level gradation, and by about 25% in the case of 256-level gradation. Thus, according to the invention, the semiconductor chip size of the source driver 17 is largely reduced.

Figure 15:
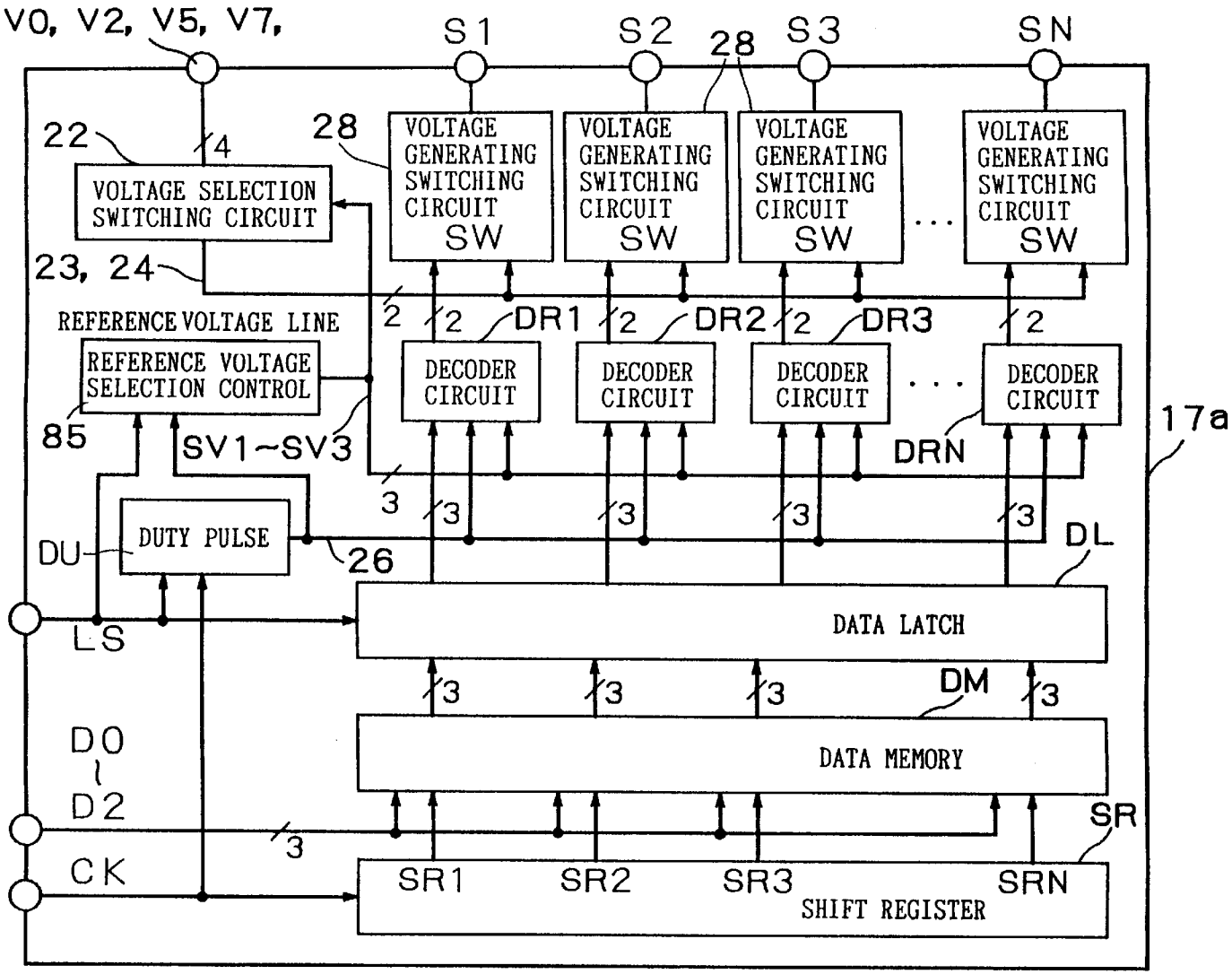
FIG. 15 is a block diagram showing a specific structure of a source driver 17*a* of another embodiment of the invention.

Although the voltage selection switching circuit 22 is disposed outside the source driver 17 in the embodiment above, the voltage selection switching circuit 22 of FIG. 11 may be disposed within a semiconductor chip forming a source driver 17*a* as shown in FIG. 15 which shows other embodiment of the invention. According to the embodiment of FIG. 15, it is only necessary to dispose input connection terminals for the four reference voltages V0, V2, V5 and V7, whereas the embodiment of FIG. 2 requires in total five input connection terminals, two for the two reference voltage lines 23 and 24 and three for the three reference voltage control signals SV1, SV2 and SV3. Thus, the embodiment of FIG. 15 uses one less input connection terminals.

Figure 16:
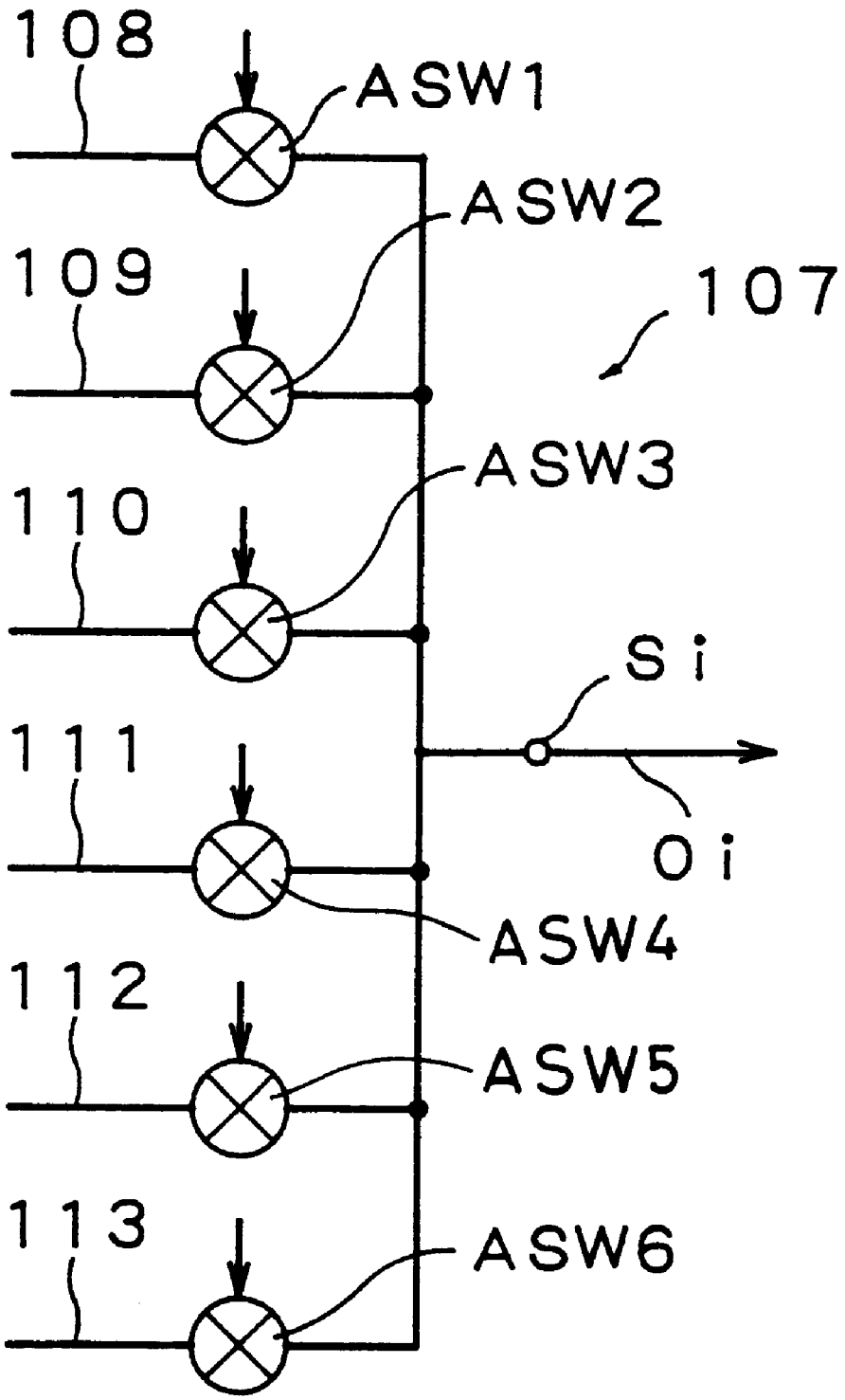
FIG. 16 is an electric circuit diagram showing a specific structure of a voltage generating switching circuit 107 of another embodiment of the invention.
Figures 17A, 17B, 17C, 17D, 17E, 17F:
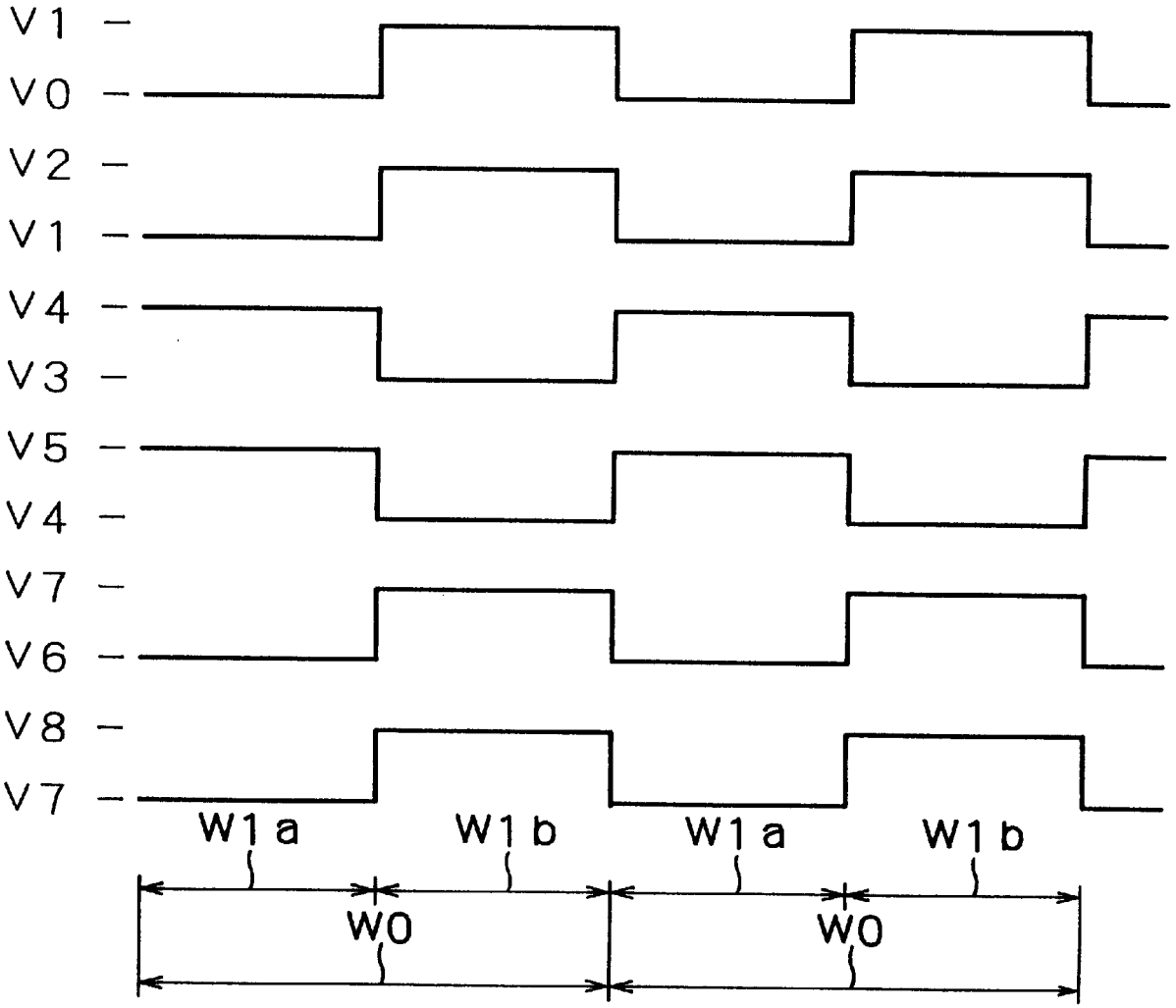
FIGS. 17A to 17F are views for describing an operation of the embodiment of FIG. 16.

FIG. 16 is an electric circuit diagram of a voltage generating switching circuit 107 according to another embodiment of the invention. Analog switches ASW1 to ASW6 which serve as switching elements for generating voltage are interposed in six reference voltage lines 108 to 113. The reference voltages V0 to V8 supplied from the reference voltage source 21 are combined and supplied to the reference voltage lines 108 to 113. For the reference voltages V0 to V8, a first voltage combination is defined as (V0, V1, V4, V5, V6, V7), and a second voltage combination as (V1, V2, V3, V4, V7, V8). As shown in FIGS. 17A to 17F, the first voltage combination is supplied to the reference voltage in the earliest first time period W1a, and in the next first time period W1b the second voltage combination is supplied to the reference voltage lines 108 to 113. Two of the analog switches ASW1 to ASW8 are simultaneously turned on or off under the control of a predetermined duty ratio of the first time periods W1a and W1b, whereby a vibrating voltage is supplied to the source line 0i.

The embodiment of FIGS. 16 and 17A to 17F is similar in structure to the foregoing embodiment. However, it is to be noted that this embodiment realizes in total 16 levels of gradation display. Display data for each source line 0i consists of four bits D0 to D3 as shown in Table 2. Intermediate voltages V01, V12, V23, V34, V45, V56 and V67 between the reference voltages V0 to V8 are obtained in a similar manner to that of the foregoing embodiment using a duty pulse having a duty ratio of 1:1. For example, to generate the voltage V01, in one first time period W1a of the two first time periods W1a and W1b, only the analog switch ASW1 is conducted during half that period while the analog switch ASW2 is conducted during the remaining half of that period. As a result, the voltage V01 which is obtained by averaging the reference voltages V0 and V1 is supplied to the source line 0i. This is also true with the other intermediate voltages V12, V23, V34, V45, V56 and V67.

TABLE 2

| Gradation Display Data | | | | |
|---|---|---|---|---|
| D3 | D2 | D1 | D0 | Output Voltage Value |
| 0 | 0 | 0 | 0 | V0 |
| 0 | 0 | 0 | 1 | $V01 = \frac{V0 + V1}{2}$ |
| 0 | 0 | 1 | 0 | V1 |
| 0 | 0 | 1 | 1 | $V12 = \frac{V1 + V2}{2}$ |
| 0 | 1 | 0 | 0 | V2 |
| 0 | 1 | 0 | 1 | $V23 = \frac{V2 + V3}{2}$ |
| 0 | 1 | 1 | 0 | V3 |
| 0 | 1 | 1 | 1 | $V34 = \frac{V3 + V4}{2}$ |
| 1 | 0 | 0 | 0 | V4 |
| 1 | 0 | 0 | 1 | $V45 = \frac{V4 + V5}{2}$ |
| 1 | 0 | 1 | 0 | V5 |
| 1 | 0 | 1 | 1 | $V56 = \frac{V5 + V6}{2}$ |
| 1 | 1 | 0 | 0 | V6 |
| 1 | 1 | 0 | 1 | $V67 = \frac{V6 + V7}{2}$ |
| 1 | 1 | 1 | 0 | V7 |
| 1 | 1 | 1 | 1 | V8 |

In the invention, as the number of levels of gradation increases, for example, from 8 levels to 16 levels, 32 levels, 64 levels, . . . 256 levels, the value a of the duty ratio 1:a (a is a natural number) needs to be increased and driving voltages corresponding to higher levels of gradation need to be generated using as less number of types of reference voltages as possible. When the value a is increased, a charging time for charging up the equivalent static capacity Cs of the liquid crystal panel 16 must be shortened, which makes it difficult to obtain a desired vibrating voltage from vibration. To deal with this problem, in this invention, the number of the reference voltages is increased, the value a of the duty pulse 1:a is reduced and the charging time is lengthened. Using a structure in which the resistances of the source lines 01 to 0N of the liquid crystal panel 16 are reduced, for example, using a metal material which has a small wire resistance, or using other structure, it is possible to avoid a situation that the value a must be increased.

Figure 18:
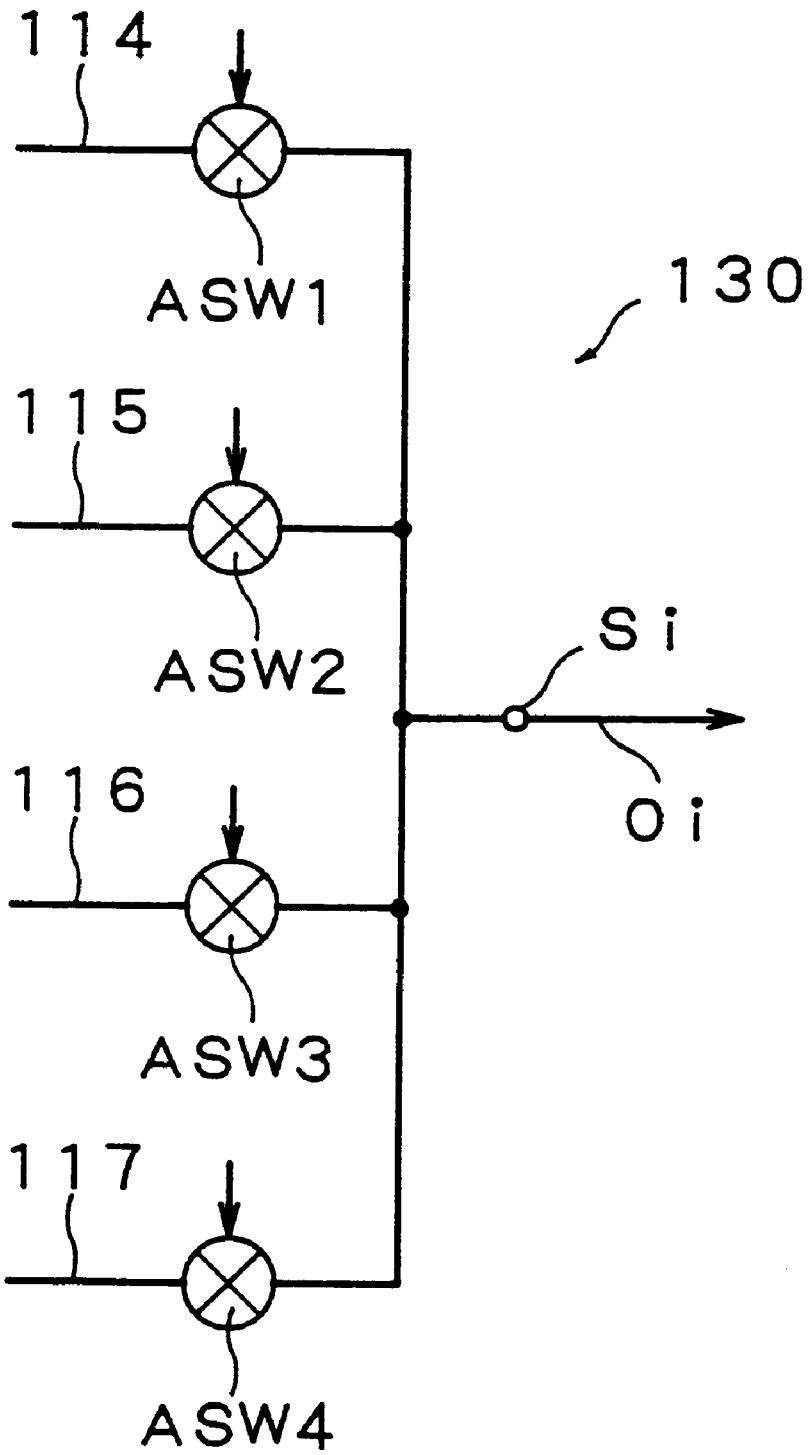
FIG. 18 is an electric circuit diagram showing a specific structure of a voltage generating switching circuit 130 of another embodiment of the invention.
Figures 19A, 19B, 19C, 19D:
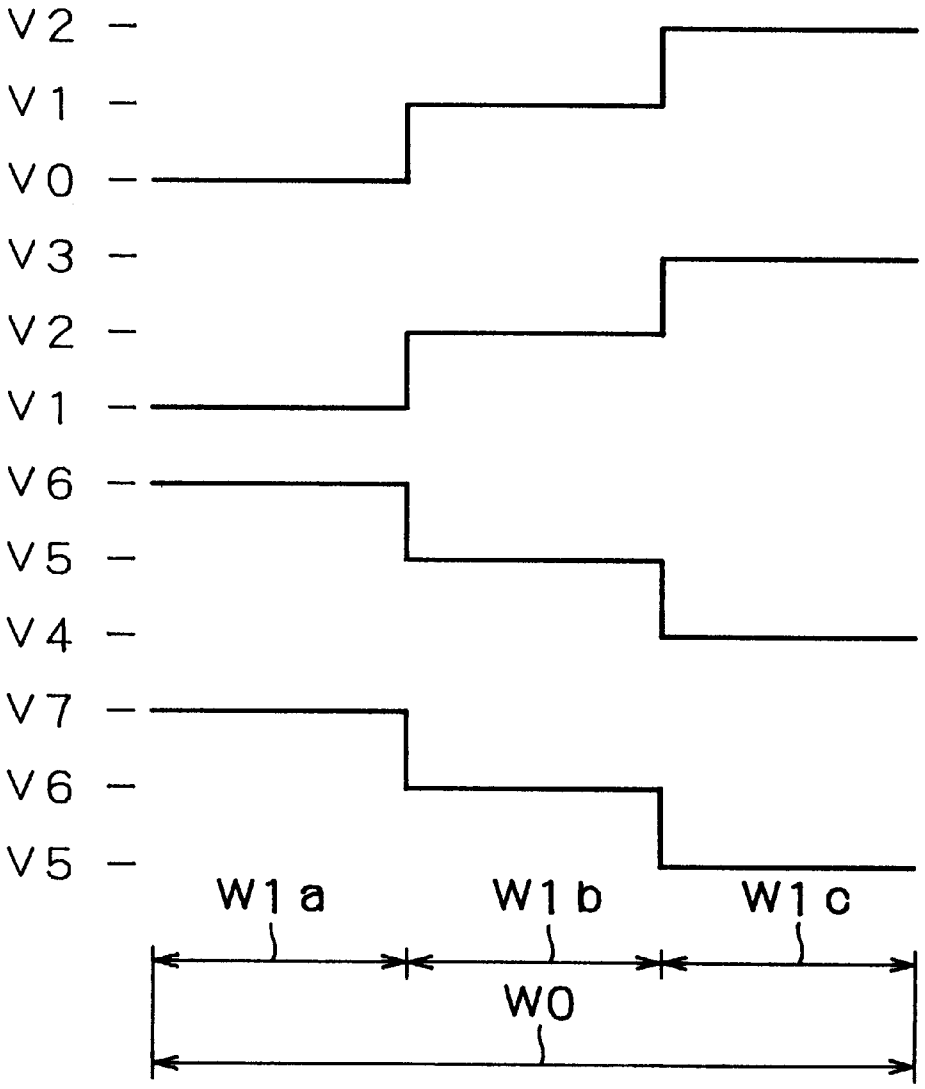
FIGS. 19A to 19D are views for describing an operation in the embodiment of FIG. 18.

In the voltage generating switching circuit 130 of FIG. 18 showing another embodiment of the invention, the analog switches ASW1 to ASW4 are interposed in four reference voltage lines 114, 115, 116 and 117. The reference voltages V0 to V7 are supplied to the reference voltage lines 114 to 117 from the reference voltage source 21 which generates the reference voltages V0 to V7 through the reference voltage selection switching circuit 22 for each of the periodic first time periods W1a, W1b and W1c as shown in FIGS. 19A to 19D so that combinations (V0, V1, V6, V7), (V1, V2, V5, V6) and (V2, V3, V4, V5) of the reference voltages V0 to V7 are outputted and applied in the first time periods W1a, W1b and W1c. Any two of the analog switches ASW1 to ASW4 are turned on and off under the control with a pre-selected duty ratio in any of the three first time periods W1a, W1b and W1c, whereby voltages between the reference voltages arc generated and supplied to the source line 0i.

In the embodiment of FIGS. 16 to 19A–D, the combinations of the reference voltages are different from each other between the first time periods W1a, W1b and W1c. Hence, a time for generating intermediate voltages between the reference voltages is eliminated.

In another embodiment of the invention, the reference voltage source 21 may have a structure wherein reference voltage V0, V1, V2, . . . , V2m+3 (m=0, 1, 2, 3, . . . ) are generated and supplied to the reference voltage lines 114 to 117 in one cycle W0 consisting of first time periods W1a, W1b, W1c, . . . , W1d as shown in Table 3, in a voltage generating switching circuit 130 as shown in FIG. 18.

TABLE 3

| | One Cycle WO | | | | | |
|---|---|---|---|---|---|---|
| Switch | W1a | W1b | W1c | . . . | W1d | |
| ASW1 | VO | V1 | V2 | . . . | Vm | First |
| ASW2 | V1 | V2 | V3 | . . . | Vm + 1 | Group |
| ASW3 | V2m + 2 | V2m + 1 | V2m | . . . | Vm + 2 | Second |
| ASW4 | V2m + 3 | V2m + 2 | V2m + 1 | . . . | Vm + 3 | Group |

In the embodiment of the invention, at least two pairs (two pairs in the embodiment) of input terminals, that is, the reference voltage lines 114, 115; 116, 117 are respectively provided and the analog switches ASW1, ASW2; ASW3, ASW4 serving as the voltage generating switching elements are respectively interposed between the reference voltage lines 114, 115; 116, 117. Plural reference voltages V0 to V2m+3 supplied to the reference voltage lines are, as shown in Table 3, divided into in total two groups, which are the first one consisting of the reference voltage V0 to Vm and V1 to Vm+1 corresponding to the first pair of the reference voltage lines 114 and 115 and the second one consisting of the reference voltages V2m+2 to Vm+2 and V2m+3 to Vm+3 corresponding to the second pair of the reference voltages 116 and 117.

The plural reference voltages V0 to Vm+1 of the first group, supplied to the reference voltage lines 114 and 115 through the first pair of input terminals by the operation of the reference voltage selecting switching circuit 22 are supplied in a time sharing mode in sequence of from low to high or from high to low of the plural reference voltages V0 to Vm+1 (from low to high in this embodiment) in the first time periods W1a, W1b, W1c, . . . , W1d of the cycle W0, respectively, which is repeated in plural times (m+1 times in this embodiment). Any two reference voltages adjacent to each other which are supplied at one time to the reference voltage lines 114 and 115 in the first periods W1a, W1b, Wic, . . . , W1d are different by a predetermined potential in the first group in sequence of from low to high of the reference voltages V0 to Vm+1. For example, in the embodiment, the reference voltages V0 to Vm supplied to the analog switch ASW1 through the reference voltage line 114 and the reference voltages V1 to Vm+1 supplied to the analog switch ASW2 through the reference voltage line 115 are shifted in sequence of from low to high of the reference voltages by one reference voltage from each other. With respect to the reference voltage lines 116 and 117, plural voltages Vm+2 to V2m+3 are supplied to another pair of the reference voltage lines 116 and 117 in a time sharing mode in sequence from high to low of the reference voltages Vm+2 to V2m+3, and the other structural details are the same as in the pair of the reference voltage lines 114 and 115 mentioned above.

In the embodiment of the invention shown in FIG. 18, two pairs of input terminals, that is, the reference voltage lines 114, 115; 116, 117 are provided, however, a similar structure including the reference voltage lines 108, 109; 110, 111; 112, 113 corresponding to three pairs of input terminals as described in relation to FIG. 16 may be realized, and the invention may be also embodied with four or more pairs of input terminals.

Figure 20:
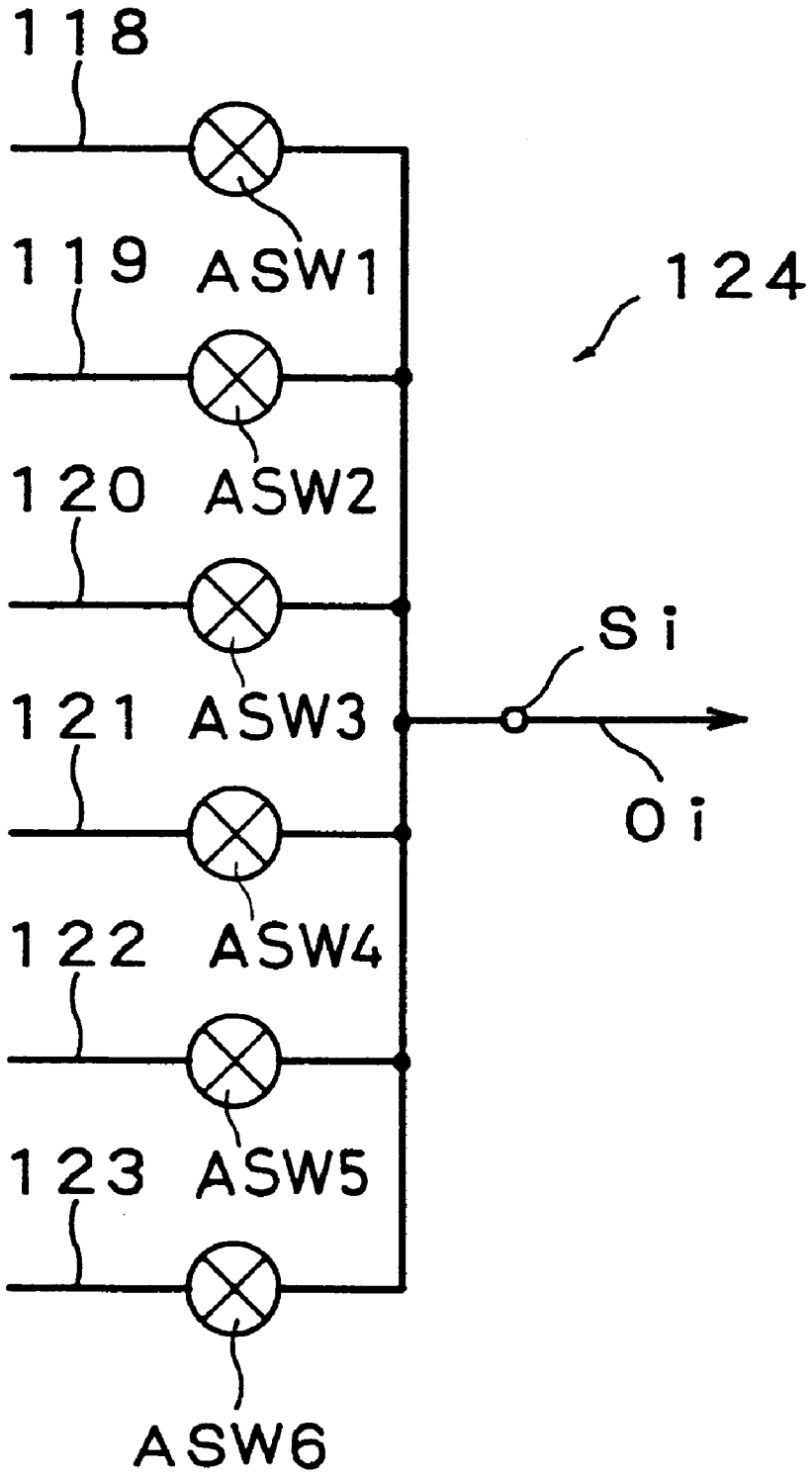
FIG. 20 is an electric circuit diagram showing a specific structure of a voltage generating switching circuit 124 of still another embodiment of the invention.
Figures 21A, 21B, 21C, 21D, 21E, 21F:
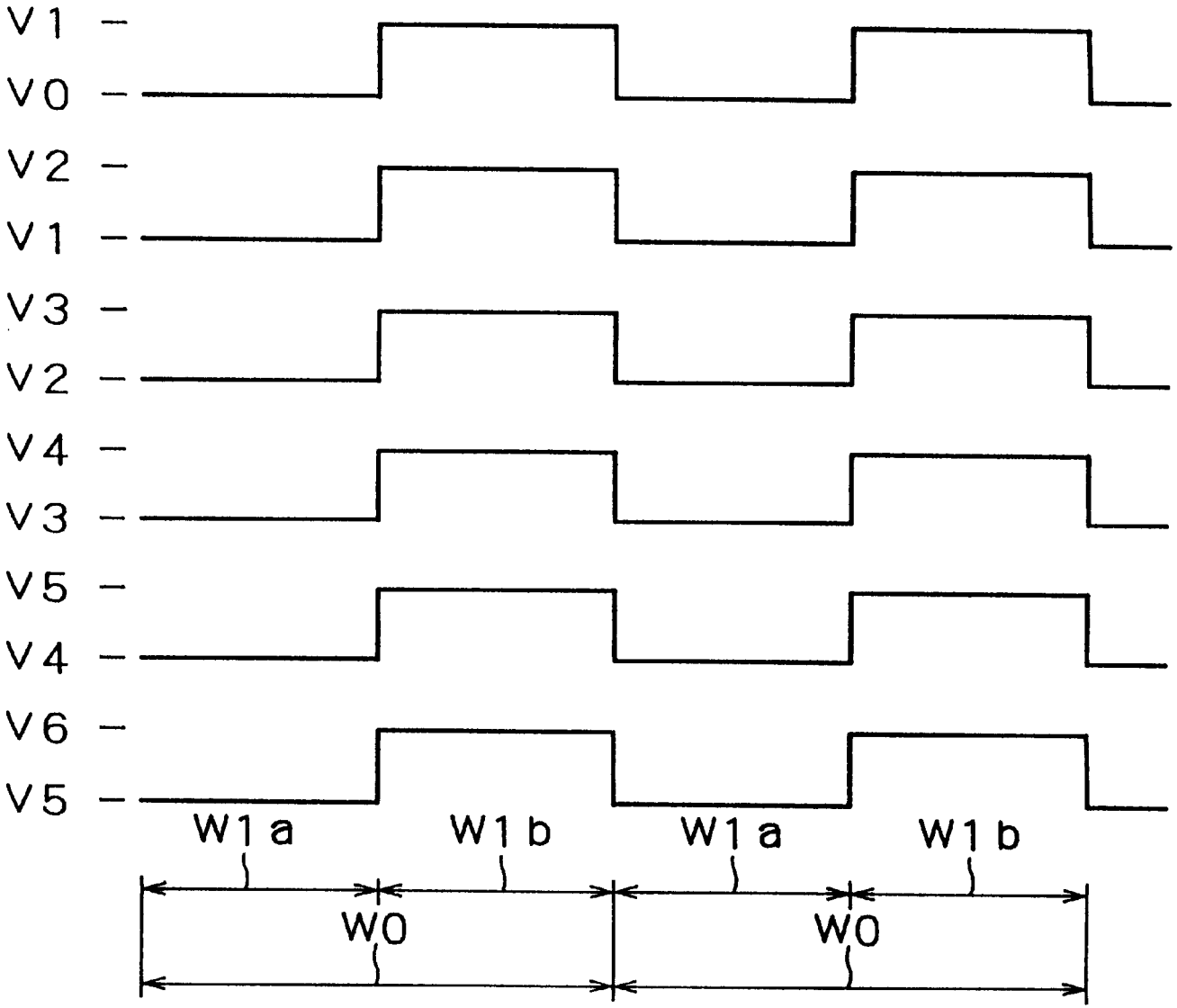
FIGS. 21A to 21F are views for describing an operation in the embodiment of FIG. 20.

FIG. 20 is an electric circuit diagram of a voltage generating switching circuit 124 of still another embodiment of the invention. Analog switches ASW1 to ASW6 are interposed between voltage lines 118 to 123. Reference voltages V0 to V6 as those shown in FIGS. 21 A to 21 F are supplied to the reference voltage lines 118 to 123 in the two first time periods W1a and W1b, whereby combinations (V0, V1, V2, V3, V4, V5) and (V1, V2, V3, V4, V5, V6) of the reference voltages V0 to V6 are outputted and applied. In the embodiment of FIGS. 20 and 21, the combination of the reference voltages V1 and V2 in one first time period W1a of the first time periods is the same with the combination of the reference voltages V1 and V2 in the other first time period W1b of the first time periods. This is also true with the other reference voltages V2 to V5. Such a structure is also included in the spirit of the invention.

Figure 22:
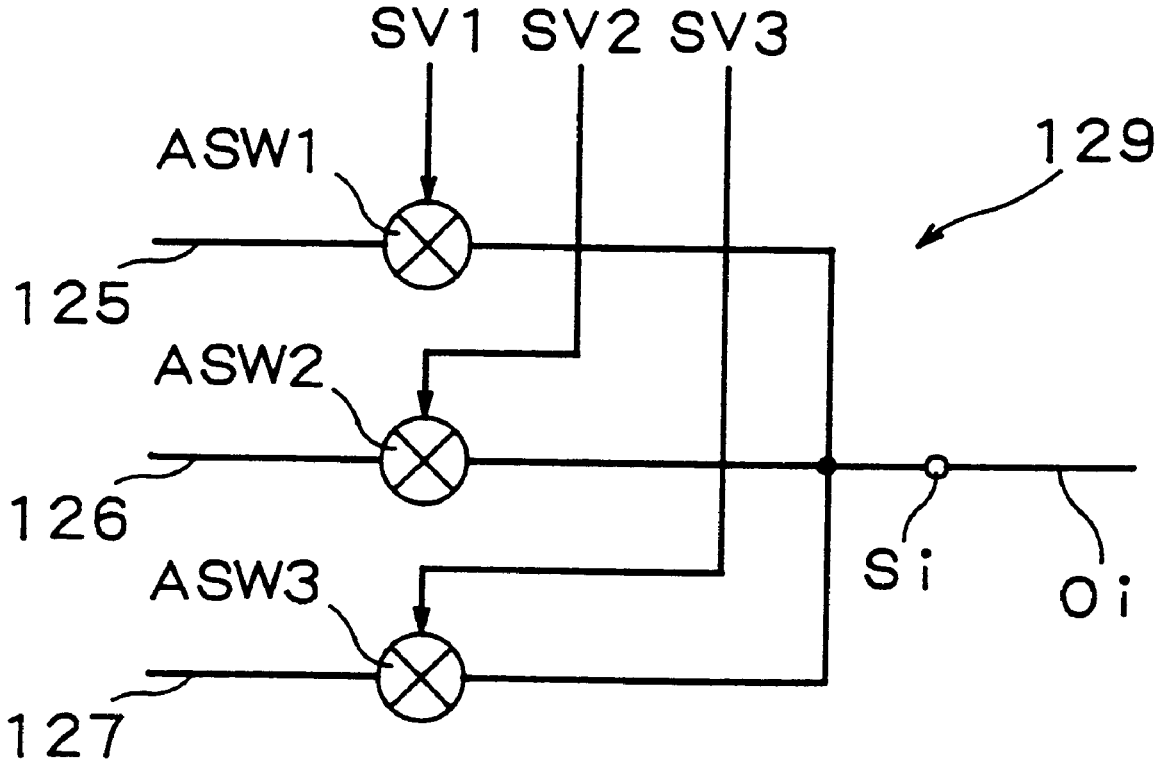
FIG. 22 is an electric circuit diagram showing a specific structure of a voltage generating switching circuit 129 of still further embodiment of the invention.
Figure 23:
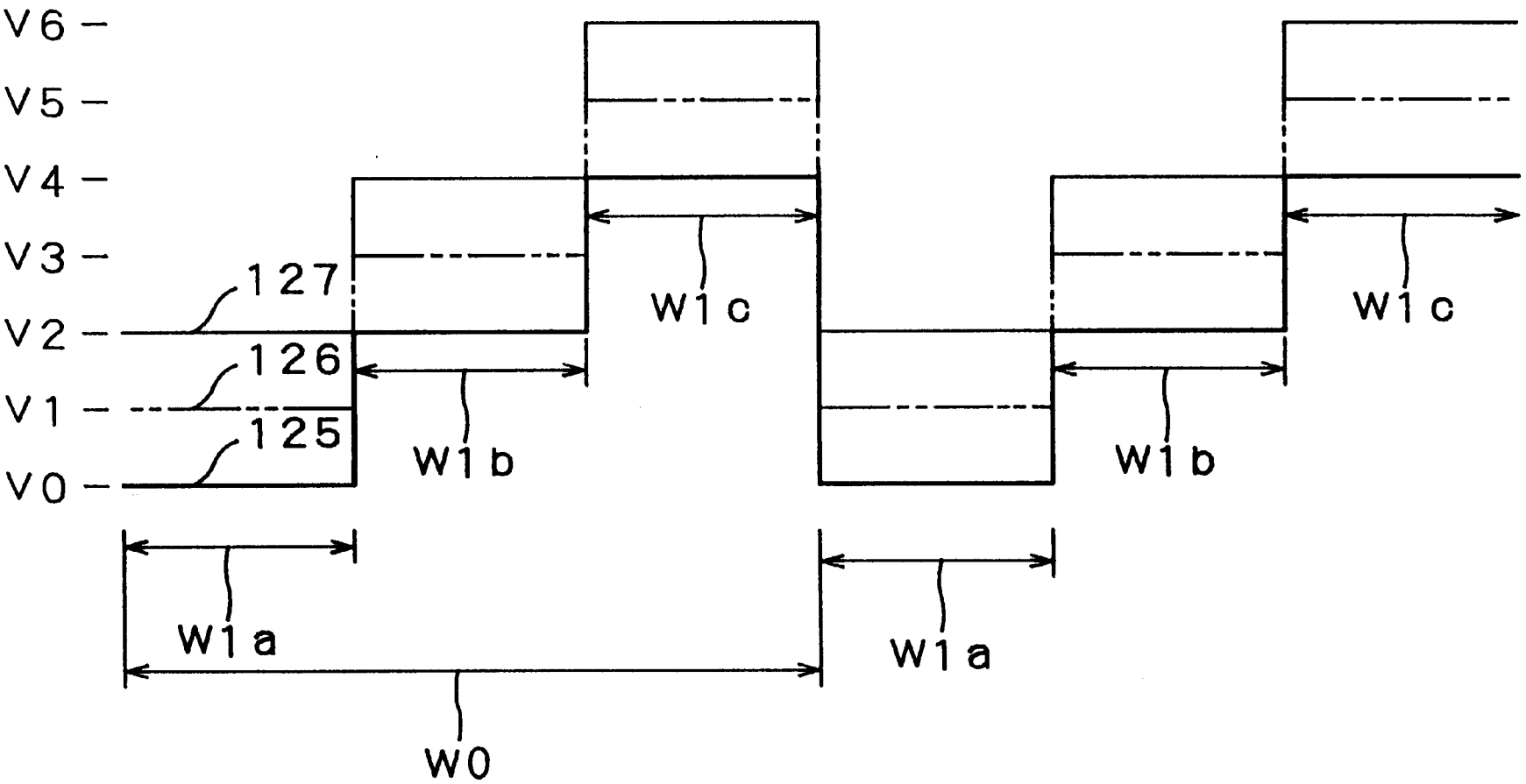
FIG. 23 is a view for describing an operation in the embodiment of FIG. 22.

FIG. 22 is an electric circuit diagram of a voltage generating switching circuit 129 according to a still further embodiment of the invention. Analog switches ASW1 to ASW3 are interposed in three reference voltage lines 125, 126 and 127. As shown in FIG. 23, in total three first time periods W1a, W1b and W1c are serially set in the one cycle W0 for the reference voltage lines 125 to 127. As in the embodiments described before, the combinations (V0, V1, V2), (V2, V3, V4) and (V4, V5, V6) of the reference voltages which are different from each other are supplied to the reference voltage lines 125 to 127 from the device for generating multiple value voltages in the first time periods W1a, W1b and W1c. Of the analog switches ASW1 to ASW3, voltages directly adjacent to each other above and below the reference voltage lines 125 to 127, e.g., the reference voltages V0 and V1 or V1 and V2, are supplied to the analog switches ASW1 and ASW2. Turning on and off of such analog switches ASW1 and ASW2 is serially controlled with time in a second time period (e.g., W2 and W3 as shown in FIG. 12B) within the first time period W1a, whereby a desired voltage between the reference voltages V0 and V1 is obtained. Alternatively, turning on and off of the analog switches ASW2 and ASW3 forming a pair is controlled for the second time period within the first time period W1a, whereby a desired voltage between the reference voltages V1 and V2 is obtained. As in the embodiments described above, one cycle W0 may be one horizontal scanning period WH or shorter than one horizontal scanning period WH. The same operation to be performed in the cycle W0 may be repeated within the horizontal scanning period WH. The operation in the first time period W1a described above may be performed in either of the second time periods W1b and W1c to generate a desired voltage which is to be supplied to the source line 0i.

As another embodiment of the invention, the reference voltages V0 to V4 supplied from the reference voltage source 21 in the time periods W1a and W1b of the repeated cycle W0 may be supplied to the analog switches ASW1 to ASW3 of the voltage selecting switching circuit 22 through the reference voltage lines 125 to 127, as shown in Table 4, using three analog switches ASW1 to ASW3 shown in FIG. 22.

TABLE 4

| | One Cycle WO | |
|---|---|---|
| Switch | W1a | W1b |
| ASW1 | V0 | V2 |
| ASW2 | V1 | V3 |
| ASW3 | V2 | V4 |

Figure 24:
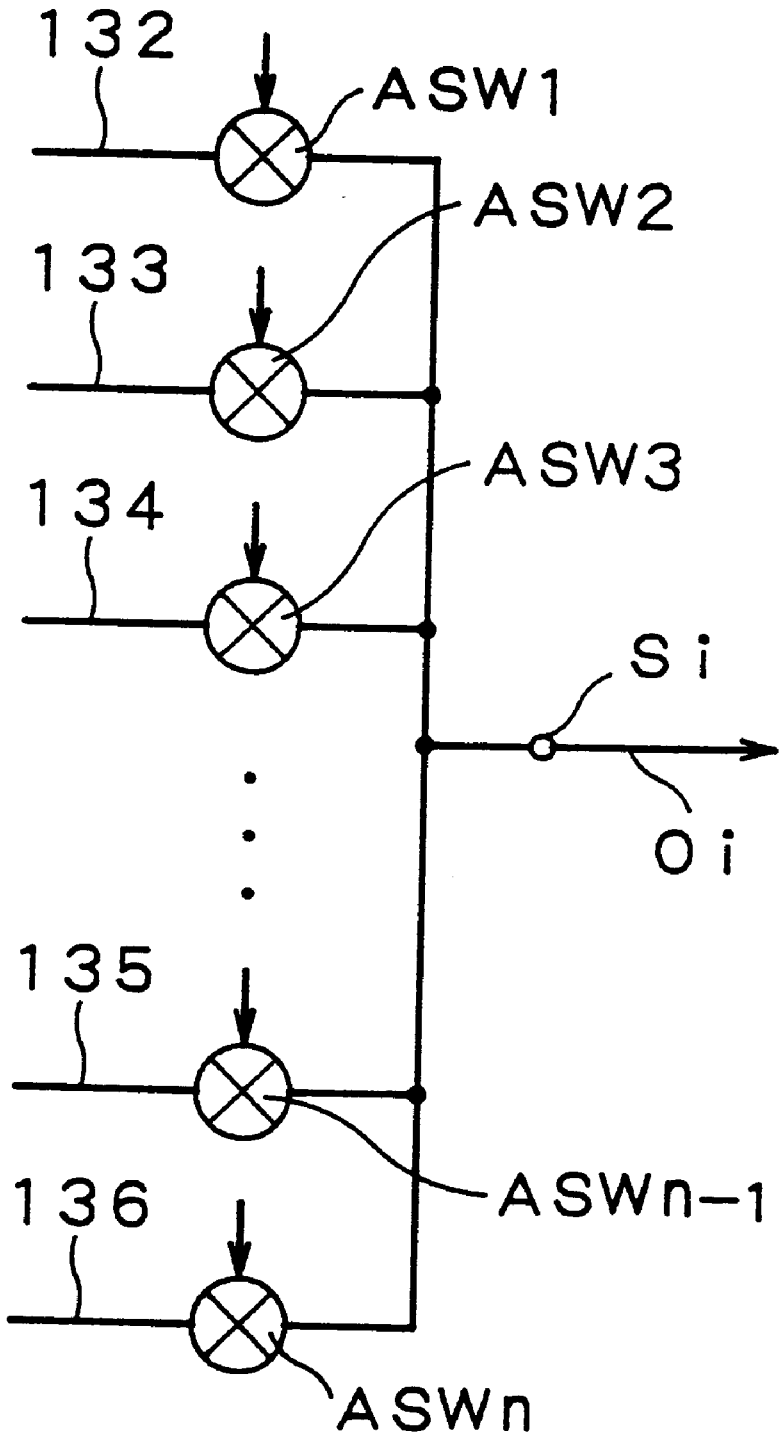
FIG. 24 is an electric circuit diagram showing a specific structure of a voltage generating switching circuit of another embodiment of the invention.

As still another embodiment of the invention, using in total n analog switches ASW1 to ASWn in the manner as shown in FIG. 24, instead of the analog switches ASW1 to ASW3 in FIG. 22, the reference voltages are supplied from the reference voltage source which generates reference voltages V0 to V(q+1)n of Table 5 to reference voltage lines 132 to 136 through the voltage selecting switching circuit 22. The reference characters q and n are natural numbers.

TABLE 5

| | One Cycle WO | | | | |
|---|---|---|---|---|---|
| Switch | W1a | W1b | W1c | . . . | W1d |
| ASW1 | VO | Vn | V2n | . . . | Vqn |
| ASW2 | V1 | Vn + 1 | V2n + 1 | . . . | Vqn + 1 |
| ASW3 | V2 | Vn + 2 | V2n + 2 | . . . | Vqn + 2 |
| . | . | . | . | . | . |
| . | . | . | . | . | . |
| . | . | . | . | . | . |
| ASWn − 1 | Vn − 1 | V2n − 1 | V3n − 1 | . . . | V(q + 1)n − 1 |
| ASWn | Vn | V2n | V3n | . . . | V(q + 1)n |

In the embodiment shown in FIG. 24, n analog switches ASW1 to ASWn (n is plural) are respectively disposed at the reference voltage lines 132 to 136 each corresponding to the output terminals Si each. When the number of the reference voltage lines 132 to 136, accordingly, the number of the analog switches ASW1 to ASWn, is defined as a first plural number, a second plural number or the number of the reference voltages V0 to V(q+1)n is larger than the first plural number.

The reference voltages V0 to V(q+1)n are supplied to the reference voltage lines 132 to 136, accordingly, to the analog switches ASW1 to ASWn, in sequence of from low to high or from high to low (from low to high in the embodiment) of the reference voltages V0 to V(q+1)n in a time sharing mode as shown in the first time periods W1a to W1b in the cycle W0, which is repeated in plural times (q+1 times in the embodiment as shown in Table 5). The reference voltages which are supplied at one time to the reference voltage lines 132 to 136, accordingly, to the analog switches ASW1 to ASWn are, for example, the ones V0 to Vn in the first time period W1a, and are the ones Vn to V2n in the first time period W1b. Similarly, the voltages V2n to V3n, . . . , Vqn to V(q+1)n respectively correspond to the first time periods W1c, . . . , W1d. Accordingly, the voltages Vn to V2n supplied in the period W1b, for example, include a reference voltage Vn same as one of the voltages V0 to Vn supplied in the former period W1a. Similarly, the voltage V2n to V3n supplied in the period W1c include a reference voltage V2n same as one of the voltages Vn to V2n supplied in the former period W1b. In this embodiment, the voltages Vn to V2n and V2n to V3n are supplied in sequence from lower to higher similarly to the voltages V0 to Vn.

Figure 25:
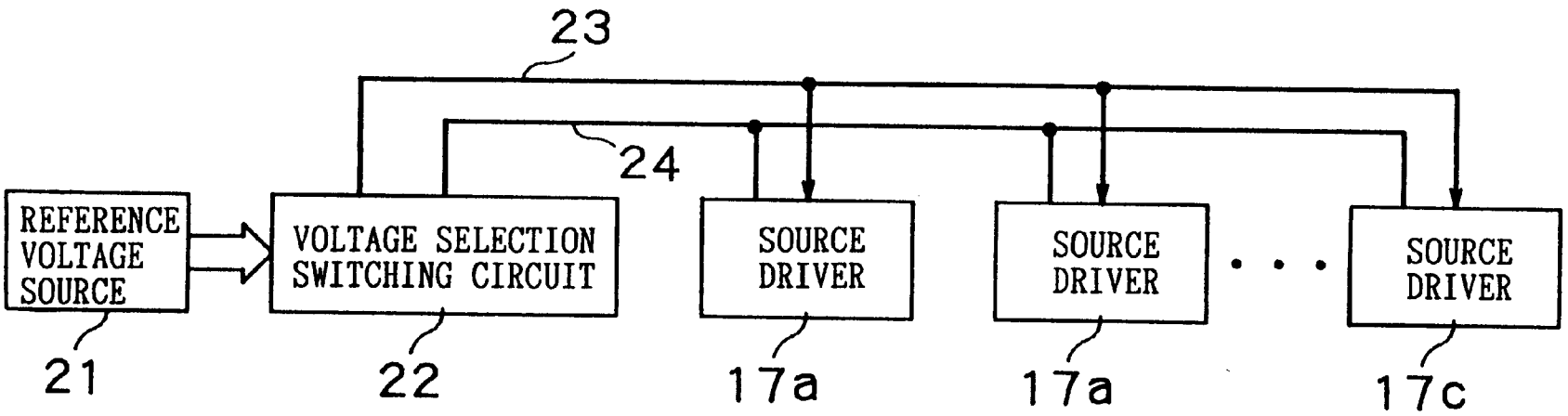
FIG. 25 is an electric circuit diagram showing a partial structure of still another embodiment of the invention.

FIG. 25 is an electric circuit diagram showing a portion of a structure of another embodiment of the invention. In this embodiment, for example, in the case where the total number N of the source lines 01 to 0N of the display panel 16 is large, plural source drivers 17*a* to 17*c* are disposed and the reference voltage lines 23 and 24 are connected in common to the source drivers 17*a* to 17*c*. The reference voltage source 21 and the voltage selection switching circuit 22 are disposed in common to the source drivers 17*a* to 17*c*. Hence, structural simplification is realized in the embodiment.

In the embodiment of FIG. 25, the source drivers 17*a* to 17*c* may have the structure described referring to FIGS. 1 to 14, or may have the structure described referring to FIG. 15.

The other structures of the embodiments of FIGS. 1G to 24 are the same as the structures of the embodiments shown in FIGS. 1 to 14 and 15.

As still another embodiment of the invention, when the static capacity Cs of FIG. 14 is small, a capacitor which forms an additional static capacity in the display panel 16 may be formed.

Figure 26:
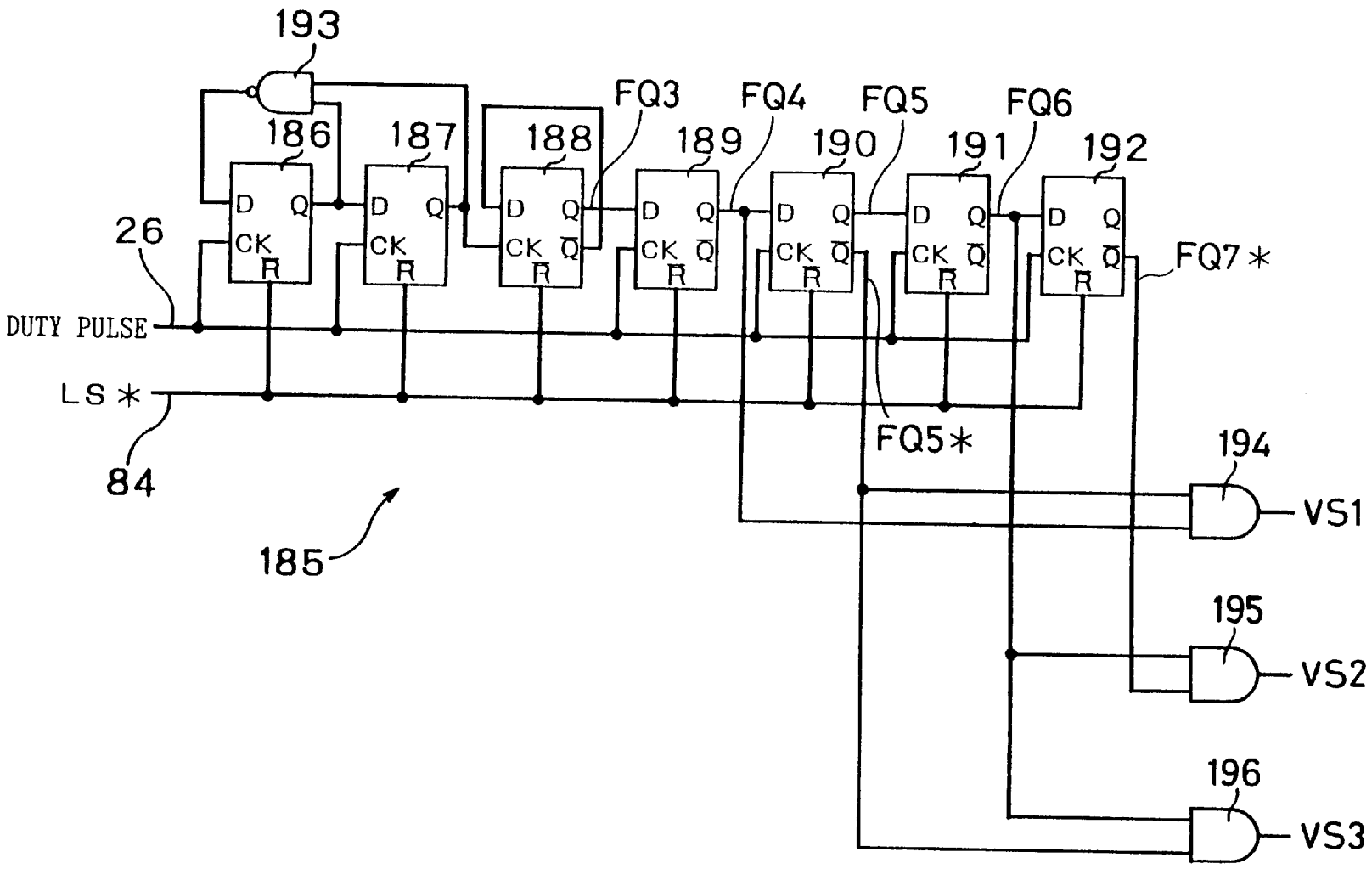
FIG. 26 is a block diagram showing a specific structure of a reference voltage selection control means 185 of still another embodiment of the invention.

FIG. 26 is a block diagram showing a specific structure of device for controlling reference voltage selection 185 in still another embodiment of the invention. The reference voltage selection controlling device 185 may be replaced by the reference voltage selection control device 85 in the source driver 17. In the reference voltage selection control device 185, D-type flip-flops 186 to 192 and a NAND gate 193 respectively correspond to the D-type flip-flops 86 to 92 and the NAND gate 93 in the reference voltage selection control means 85 and perform the same operations as them. Namely, the pulse is frequency-divided into three and is inputted into a flip-flop 189 as a signal FQ3. The signal FQ3 is sequentially inputted into the flip-flops of the next stage in accordance with the timing when the duty pulse is inputted.

A reference voltage control signal VS1 is outputted from an AND gate 194 based on a signal FQ4 outputted from the flip-flop 189 and a signal FQ5* outputted from the flip-flop 190. A reference voltage control signal VS2 is outputted from an AND gate 195 based on a signal FQ7* outputted from the flip-flop 192 and a signal FQ6 outputted from the flip-flop 191. A reference voltage control signal VS3 is outputted from an AND gate 196 based on a signal FQ5* outputted from the flip-flop 190 and a signal FQ6 outputted from the flip-flop 191. The reference voltage control signals VS1 to VS3 are inputted into a decoder circuit DR, the voltage selecting switching circuit 22 and so on, similarly to the reference voltage control signals SV1 to SV3.

Figure 27:
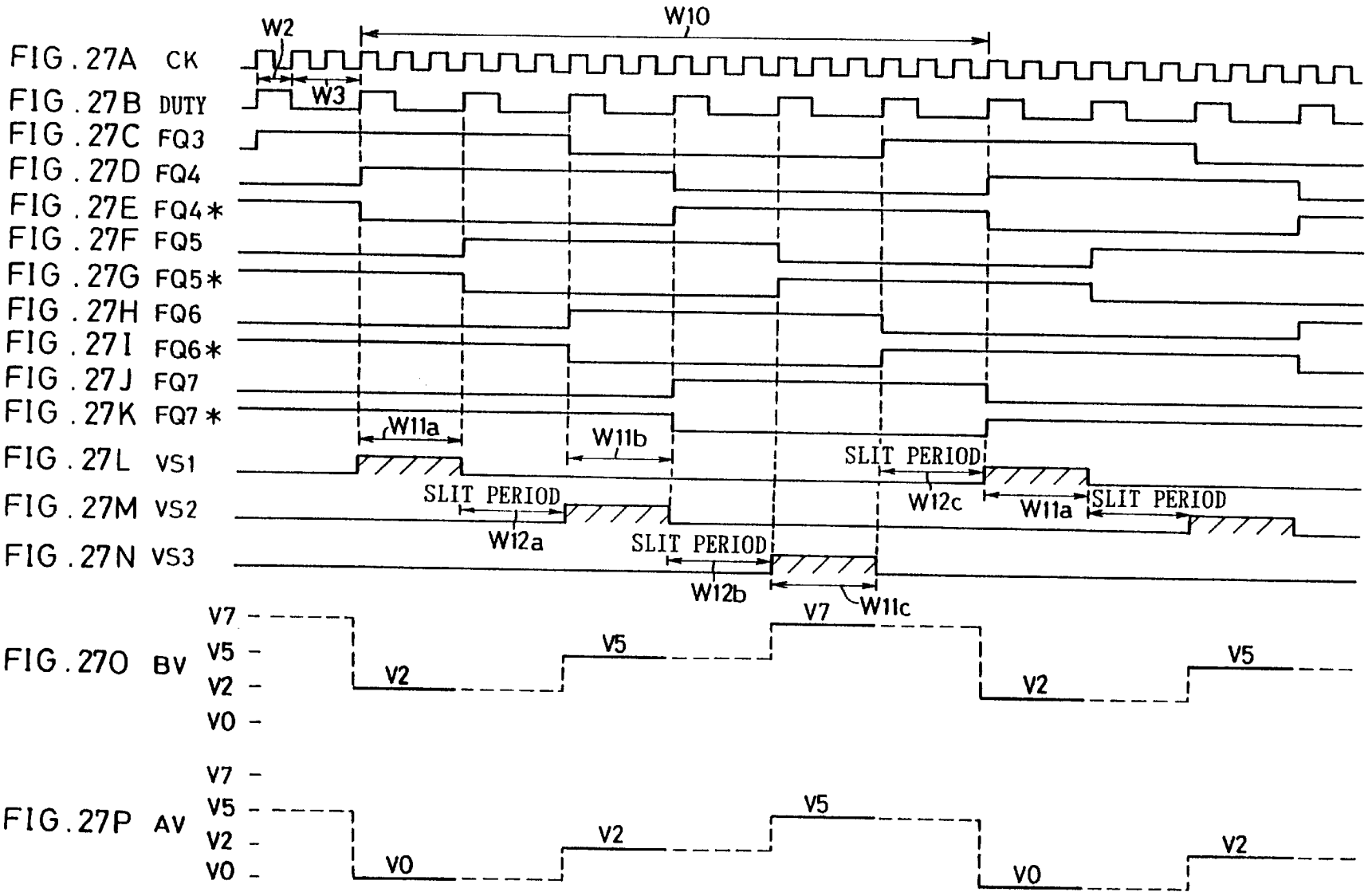
FIGS. 27A to 27P are views for describing an operation of the reference voltage selection control means 185.

FIG. 27A–27P are diagrams for describing the operation of the device for controlling of reference voltage selection 185. The duty pulse shown in FIG. 27B is generated in a duty pulse generation circuit DU based on a clock signal CK shown in the FIG. 27A. When the duty pulse and a latch signal LS* formed by inverting the latch signal LS are inputted into the reference voltage selection control device 185, respective signals shown in FIG. 27 C to K are outputted from respective flip-flops. The signal FQ3 shown in FIG. 27C is a signal obtained by frequency-dividing the duty pulse into three and is outputted from the flip-flop 188. Reference voltage control signals VS1 to VS3 each shown in FIG. 27L to N are outputted based on the respective signals inputted into the AND gates 194 to 196, as described above.

The interval between the end of a period W11a when the reference voltage control signal VS1 is at high level and the start of a period W11b when the reference voltage control signal VS2 is at high level is defined as a slit period W12*a* when no reference voltage control signals are at high level. The interval between the end of the period W11b and the start of a period W11c when the reference voltage control signal VS3 is at high level is defined as a slit period W12b. The interval between the end of the period W11c and the start of the period W11a is defined as a slit period W12c.

The periods W11a, W11b and W11c respectively correspond to the first time periods W1a, W1b and W1c. In the period W11a, the voltage V0 is outputted from a terminals AV as shown in FIG. 27P and the voltage V2 is outputted from a terminal BV as shown in FIG. 270. In the period W11b, the voltage V2 is outputted from a terminal AV and the voltage V5 is outputted from a terminal BV. In the period W11c, the voltage V5 is outputted from a terminal AV and the voltage V7 is outputted from a terminal BV.

The periods W11a, W12a, W11b, W12b, W11c and W12c are selected in this order and a total period of these periods is defined as a period W10.

The period W10 wherein three combinations of the reference voltages are repeated may be selected to be equivalent to said one horizontal scanning period WH or to be longer than the horizontal scanning period WH. In the embodiment, three first time periods W11a, W11b and W11c contained in the cyclic period W10 are set equal to each other, however, as another embodiment of the invention, these three first time periods W11a, W11b and W11c may be different from each other.

Additionally, in the embodiment, the slit periods W12a, W12b and W12c are synchronized with the duty pulse, however, they are not required to be synchronized with the duty pulse. Namely, any structure will be applicable as long as any two reference voltages are not at a high level at the time when the respective reference voltages change over, even in the case where all the high-level periods of reference voltage control signals are not equal to each other in length, or in the case where they are equal to each other and based on other signals. In the embodiment, the multiple value voltage generating device comprises the reference voltage source and the voltage selecting switching circuit 22 and the reference voltage selection control device 185.

As described above, in the embodiment, the slit periods W12a, W12b and W12c are present between the periods W11a, W11b and W11c when the reference voltage control signals VS1 to VS3 which are generated in the reference voltage selection control device 185 and outputted in a time sharing mode are respectively at high level. Hence, any two of analog switches ASW1*a*, ASW2*a* and ASW3*a* or any two of analog switches ASW1*b*, ASW2*b* and ASW3*b* in the voltage selecting circuit 22 are not conducted at one time. Accordingly, through current due to short circuit between two voltages may be prevented from occurring and power consumption in the source driver 17 provided with the reference voltage selection control device 185 may be reduced. Further, since the slit periods are respectively interposed between the periods W11a, W12b and W12c synchronized with the duty pulse, thus eliminating adverse effects on display occurring due to shift of timing for controlling turning on and off of control signals.

Figure 28:
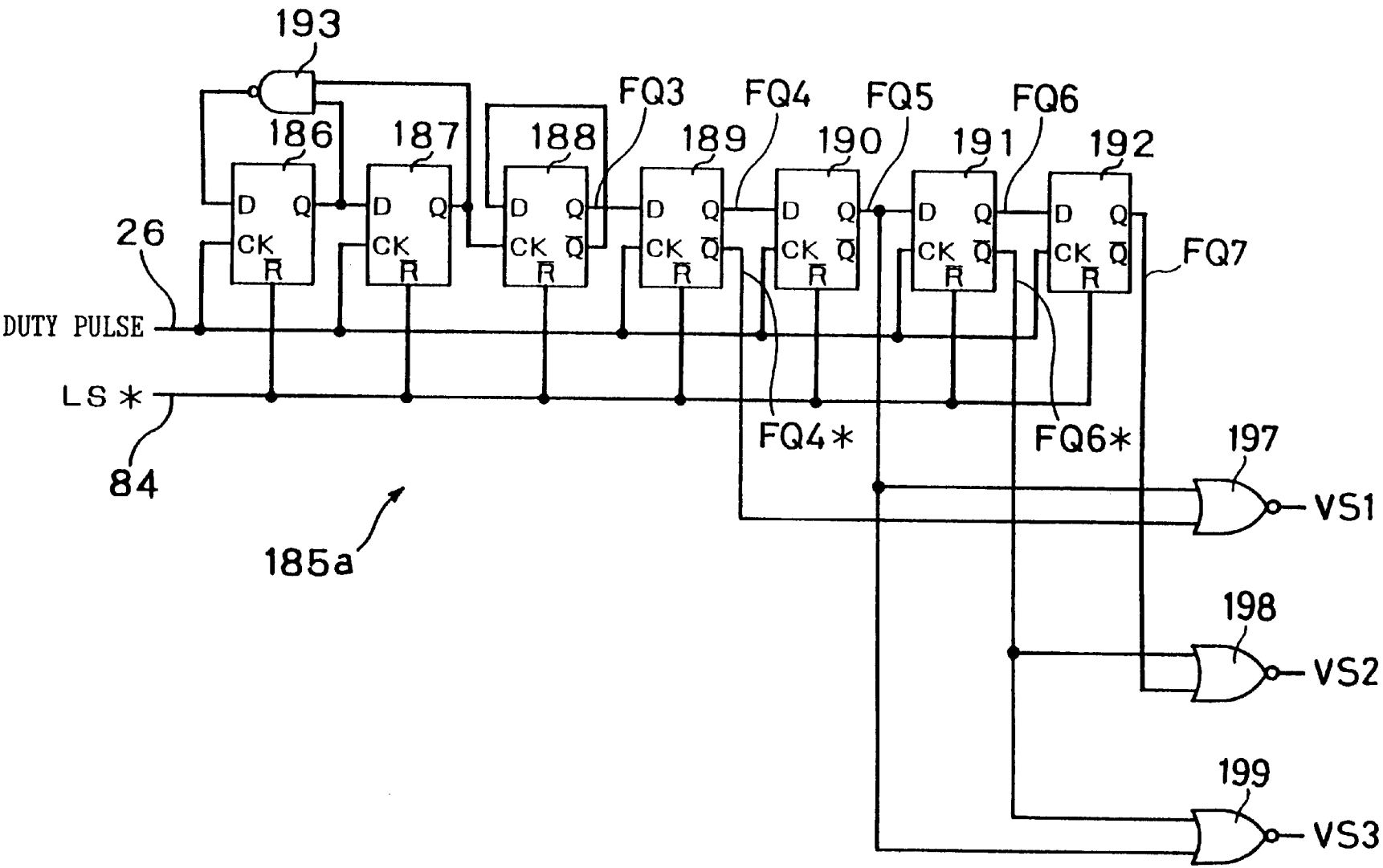
FIG. 28 is a block diagram showing a specific structure of a reference voltage selection control means 185*a* of still another embodiment of the invention.

FIG. 28 is a block diagram showing a specific structure of the device for controlling reference voltage selection 185*a* in still another embodiment of the invention. The reference voltage selection control device 185*a* has such a structure that the AND gates 194 to 196 in the reference voltage selection control device 185 are replaced by NOR gates 197 to 199, and the description on the same structural elements are omitted by designating them by the same reference characters.

In the NOR gate 197, the signals FQ4* and FQ5 are inputted therein to and the reference voltage control signal VS1 is outputted therefrom. In the NOR gate 198, the signals FQ6* and FQ7 are inputted therein to and the reference voltage control signal VS2 is outputted therefrom. In the NOR gate 199, the signals FQ5 and FQ6* are inputted therein to and the reference voltage control signal VS3 is outputted therefrom. Input and output of the signals in the reference voltage selection control means 185*a* are the same with the device for controlling reference voltage selection 185 and are shown in FIG. 27.

As described above, in the embodiment of the invention, the reference voltage selection control device 185*a* is able to perform the same operations as the reference voltage selection control device 185 and bring the same effect as that.

In the description, the input terminal may be, for example, a pin-formed connection terminal, however, in the case with no such terminal, a terminal connected to the reference voltage line such as the analog switch may be called as an input terminal. In such embodiment, an input terminal is not formed in pin form, for example, and any point on the reference voltage line may be regarded as an input terminal. Such structure is also included in the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An apparatus for driving a display apparatus, which outputs one reference voltage continuously or at least two reference voltages in a time sharing manner, to the display apparatus, the one or at least two reference voltages being selected from among plural direct current reference voltages generated by a reference voltage source in accordance with display data, the apparatus for driving a display apparatus comprising:

a plurality of input terminals;

multiple value voltage generation means, coupled to the reference voltage source, for selecting and supplying different ones of the plural direct current reference voltages to said plurality of input terminals in a time sharing manner;

output terminals coupled to the display apparatus;

a plurality of switching elements respectively interposed between each of said plurality of input terminals and each of said output terminals, said switching elements being turned on and off in response to a control signal; and control means for outputting the control signal for providing on-off control of said switching elements in accordance with the display data, said control means outputting the control signal with a predetermined timing corresponding to the display data, each of said switching elements comprising plural switches, a number of the plural switches in a switching element being less than a number of the plural direct current reference voltages generated by the reference voltage source.

2. The apparatus for driving a display apparatus of claim 1, wherein pairs of said plurality of input terminals are provided corresponding to each of said output terminals, a respective different one of said plural switches being provided for each of said plurality of input terminals as interposed between a respective one of said plurality of input terminals and a corresponding one of said output terminals, said multiple value voltage generation means supplying the plural direct current reference voltages to said plurality of input terminals corresponding to respective ones of said output terminals in sequence of from high to low or from low to high voltage with lapse of time in a time sharing manner in each repeated cycle plural times, and the plural direct current reference voltages supplied at one time to the respective input terminals of the respective pairs of said plurality of input terminals being shifted by one reference voltage with respect to each other.

3. The apparatus for driving a display apparatus of claim 1, wherein at least two respective different pairs of input terminals are provided corresponding to each of said output terminals, a respective different one of said plural switches being provided for each of said plurality of input terminals as interposed between a respective one of said plurality of input terminals and a corresponding one of said output terminals, the plural direct current reference voltages supplied by said multiple value voltage generation means being divided into plural groups for each pair of said plurality of input terminals, said multiple value voltage generation means supplying the plural direct current reference voltages to the respective pairs of said plurality of input terminals plural times in sequence of from high to low or from low to high voltage with lapse of time in a time sharing manner in each repeated cycle, and the plural direct current reference voltages supplied at one time to the respective input terminals of the respective pairs of said plurality of input terminals being shifted by one reference voltage with respect to each other.

4. The apparatus for driving a display apparatus of claim 1, wherein a first plurality of different respective input terminals are provided as corresponding to each of said output terminals, a respective different one of said plural switches being provided for each of said plurality of input terminals as interposed between a respective one of said plurality of input terminals and a corresponding one of said output terminals, said multiple value voltage generation means supplying a second plurality of the plural direct current reference voltages, which is larger in number than the first plurality of different respective input terminals, to said plurality of input terminals in sequence of from high to low or from low to high voltage with lapse of time in a time sharing manner in each repeated cycle plural times, and the plural direct current reference voltages supplied at one time to the respective input terminals of each first plurality of different respective input terminals, excluding a first supply period in each cycle, containing only one of the plural direct current reference voltages supplied in a preceding supply period.

5. The apparatus for driving a display apparatus of claim 1, wherein said switching elements and said control means are a first integrated circuit, and said multiple value voltage generation means is a second integrated circuit.

6. The apparatus for driving a display apparatus of claim 5 wherein a plurality of first integrated circuits are provided and said second integrated circuit is common to all of said plurality of first integrated circuits.

7. The apparatus for driving a display apparatus of claim 1, wherein said switching elements and said multiple value voltage generation means are one integrated circuit.

8. The apparatus for driving a display apparatus of claim 1, wherein a slit period synchronized with a predetermined cycle of the plural direct current reference voltages output from said multiple value voltage generation means is provided.

9. An apparatus for driving a display apparatus, which outputs one reference voltage continuously or at least two reference voltages in a time sharing manner, to the display apparatus, the one or at least two reference voltages being selected from among plural direct current reference voltages generated by a reference voltage source in accordance with display data, the apparatus for driving a display apparatus comprising:

a plurality of input terminals;

multiple value voltage generation means, coupled to the reference voltage source, for selecting and supplying different ones of the plural direct current reference voltages to said plurality of input terminals in a time sharing manner, slit periods wherein the plural direct current reference voltages are not supplied being inserted at intervals from ends of periods when respective ones of the plural direct current reference voltages are supplied to beginnings of respective following ones of the plural direct current reference voltages, upon changeover of the plural direct current reference voltages;

output terminals coupled to the display apparatus;

a switching element, interposed between each of said input terminals and each of said output terminals, said switching element being turned on and off in response to a control signal; and control means for outputting the control signal for providing on-off control of said switching element in accordance with the display data, said control means outputting the control signal with a predetermined timing corresponding to the display data.

10. The apparatus for driving a display apparatus of any one of claims 1 or 9 wherein said multiple value voltage generation means comprises an analog switch which is interposed between a line from which the plural direct current reference voltages are derived from the reference voltage source and each of said plurality of input terminals, and is turned on and off by a reference voltage control signal, the reference voltage control signal being periodically generated and supplied to said analog switch.

11. The apparatus for driving a display apparatus of claim 1 or 9 further comprising reference voltage selection control means for generating reference voltage control signals in accordance with a duty pulse, said multiple value voltage generation means selecting and supplying different ones of the plural direct current reference voltages to said plurality of input terminals in a time sharing manner in accordance with the reference voltage control signals.

12. The apparatus for driving a display apparatus of claim 1 or 9 further comprising reference voltage selection control means for generating reference voltage control signals in accordance with a duty pulse, said control means generating the control signal in accordance with the reference voltage control signals, the display data and the duty pulse.

13. The apparatus for driving a display apparatus of claim 9 wherein pairs of said plurality of input terminals are provided corresponding to each of said output terminals, said switching element comprising plural switches, a respective different one of said plural switches being provided for each of said plurality of input terminals as interposed between a respective one of said plurality of input terminals and a corresponding one of said output terminals, said multiple value voltage generation means supplying the plural direct current reference voltages to said plurality of input terminals corresponding to respective ones of said output terminals in sequence of from high to low or from low to high voltage with lapse of time in a time sharing manner in each repeated cycle plural times, and the plural direct current reference voltages supplied at one time to the respective input terminals of the respective pairs of said plurality of input terminals being shifted by one reference voltage with respect to each other.

14. The apparatus for driving a display apparatus of claim 9 wherein at least two respective different pairs of input terminals are provided corresponding to each of said output terminals, said switching element comprising plural switches, a respective different one of said plural switches being provided for each of said plurality of input terminals as interposed between a respective one of said plurality of input terminals and a corresponding one of said output terminals, the plural direct current reference voltages supplied by said multiple value voltage generation means being divided into plural groups for each pair of said plurality of input terminals, said multiple value voltage generation means supplying the plural direct current reference voltages to the respective pairs of said plurality of input terminals plural times in sequence of from high to low or from low to high voltage with lapse of time in a time sharing manner in each repeated cycle, and the plural direct current reference voltages supplied at one time to the respective input terminals of the respective pairs of said plurality of input terminals being shifted by one reference voltage with respect to each other.

15. The apparatus for driving a display apparatus of claim 9 wherein a first plurality of different respective input terminals are provided as corresponding to each of said output terminals, said switching element comprising plural switches, a respective different one of said plural switches being provided for each of said plurality of input terminals as interposed between a respective one of said plurality of input terminals and a corresponding one of said output terminals, said multiple value voltage generation means supplying a second plurality of the plural direct current reference voltages, which is larger in number than the first plurality of different respective input terminals, to said plurality of input terminals in sequence of from high to low or from low to high voltage with lapse of time in a time sharing manner in each repeated cycle plural times, and the plural direct current reference voltages supplied at one time to the respective input terminals of each first plurality of different respective input terminals, excluding a first supply period in each cycle, containing only one of the plural direct current reference voltages supplied in a preceding supply period.

16. The apparatus for driving a display apparatus of claim 9, wherein said switching element and said control means are a first integrated circuit, and said multiple value voltage generation means is a second integrated circuit.

17. The apparatus for driving a display apparatus of claim 9, wherein said switching element and said multiple value voltage generation means are one integrated circuit.

18. An apparatus for driving a display comprising:

a reference voltage source for generating reference voltages;

a voltage selector, coupled to said reference voltage source, for selecting and outputting different ones of the reference voltages; and a source driver for providing driving signals to a display in accordance with outputs of said voltage selector, wherein said voltage selector is for selecting and outputting a first plurality of the reference voltages in sequence to a first input terminal of said source driver, and for selecting and outputting a second plurality of the reference voltages in sequence to a second input terminal of said source driver, and wherein voltages are simultaneously applied to said first and second input terminals.

19. The apparatus for driving a display of claim 18, wherein said reference voltage source generates first through fourth reference voltages, said voltage selector selecting and outputting the first and third reference voltages in sequence to the first input terminal of said source driver and the second and fourth reference voltages to the second input terminal of said source driver.

20. The apparatus for driving a display of claim 19, wherein the second reference voltage is greater than the first reference voltage, the third reference voltage is greater than the second reference voltage and the fourth reference voltage is greater than the third reference voltage.

21. The apparatus for driving a display of claim 19, wherein said voltage selector outputs the sequence of the first and third reference voltages to the first terminal of said source driver repeatedly and outputs the sequence of the second and fourth reference voltages to the second terminal of said source driver repeatedly.

22. The apparatus for driving a display apparatus of claim 19, wherein said voltage selector synchronizes output of the first through fourth reference voltages to said source driver such that the first and second reference voltages, the second and third reference voltages and the third and fourth reference voltages are simultaneously provided as respective pairs to the first and second terminals of said source driver.

23. The apparatus for driving a display of claim 18, wherein said voltage selector selects and outputs different ones of the plurality of reference voltages in accordance with a duty pulse and a latch signal.

24. The apparatus according to claim 18, wherein the first plurality of reference voltages is a first set of a plurality of distinct reference voltages, and the second plurality of reference voltages is a second set of a plurality of distinct reference voltages.

25. A method of driving a display comprising the steps of:

a) generating reference voltages;

b) selecting and providing different ones of the reference voltages to a source driver; and c) providing driving signals from the source driver to a display in accordance with selected reference voltages of step b), said step b) comprising selecting and providing a first plurality of the reference voltages in sequence to a first input terminal of said source driver, and selecting and providing a second plurality of the reference voltages in sequence to a second input terminal of the source driver, wherein voltages are simultaneously applied to said first and second input terminals.

26. The method of driving a display of claim 25 wherein said step a) comprises generating first through fourth reference voltages, said step b) comprising selecting and providing the first and third reference voltages in sequence to the first input terminal of the source driver and the second and fourth reference voltages to the second input terminal of the source driver.

27. The method of driving a display of claim 26, wherein the second reference voltage is greater than the first reference voltage, the third reference voltage is greater than the second reference voltage and the fourth reference voltage is greater than the third reference voltage.

28. The method of driving a display of claim 26 wherein said step b) comprises providing the sequence of the first and third reference voltages to the first terminal of the source driver repeatedly and providing the sequence of the second and fourth reference voltages to the second terminal of the source driver repeatedly.

29. The method of driving a display apparatus of claim 26 wherein said step b) comprises synchronizing provision of the first through fourth reference voltages to the source driver such that the first and second reference voltages, the second and third reference voltages and the third and fourth reference voltages are simultaneously provided as respective pairs to the first and second terminals of the source driver.

30. The method of driving a display of claim 25, wherein said step b) comprises selecting and outputting different ones of the plurality of reference voltages in accordance with a duty pulse and a latch signal.

31. The method according to claim 25, wherein step b) further comprises selecting and outputting a first set of a plurality of distinct reference voltages in sequence to a first input terminal of a source driver, and selecting and outputting a second set of a plurality of distinct reference voltages in sequence to a second input terminal of the source driver.

* * * * *